US006517197B2

(12) United States Patent
Hawkins et al.

(10) Patent No.: US 6,517,197 B2
(45) Date of Patent: Feb. 11, 2003

(54) CONTINUOUS INK-JET PRINTING METHOD AND APPARATUS FOR CORRECTING INK DROP REPLACEMENT

(75) Inventors: Gilbert A. Hawkins, Mendon, NY (US); David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/804,758

(22) Filed: Mar. 13, 2001

(65) Prior Publication Data

US 2002/0130931 A1 Sep. 19, 2002

(51) Int. Cl.[7] ..... B41J 2/07
(52) U.S. Cl. ..... 347/74; 347/75
(58) Field of Search ..... 347/74, 75, 77, 347/78, 79, 80, 82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,709,432 A | | 1/1973 | Robertson | |
| 3,877,036 A | * | 4/1975 | Loeffler et al. | 347/77 |
| 3,878,519 A | | 4/1975 | Eaton | 347/75 |
| 4,068,241 A | * | 1/1978 | Yamada | 347/75 |
| 4,190,844 A | | 2/1980 | Taylor | |
| 4,346,387 A | | 8/1982 | Hertz | |
| 4,360,817 A | | 11/1982 | Arway et al. | 347/90 |
| 4,392,142 A | | 7/1983 | Seachman et al. | |
| 4,408,211 A | | 10/1983 | Yamada | 347/75 |
| 4,510,504 A | | 4/1985 | Tamai et al. | |
| 4,839,664 A | | 6/1989 | Archer et al. | 347/90 |
| 4,914,522 A | | 4/1990 | Duffield et al. | |
| 5,036,340 A | | 7/1991 | Osborne et al. | |
| 6,079,821 A | | 6/2000 | Chwalek et al. | |
| 6,161,194 A | | 12/2000 | Tanaka et al. | |

FOREIGN PATENT DOCUMENTS

EP 0 911 168 A2 * 4/1999 ..... B41J/2/105

* cited by examiner

*Primary Examiner*—Lamson Nguyen
(74) *Attorney, Agent, or Firm*—William R. Zimmerli

(57) ABSTRACT

An apparatus for printing an image is provided. The apparatus includes a source of ink. A droplet forming mechanism is operable in a first state to form droplets from the source having a first volume traveling along a first desired path and in a second state to form droplets from the source having a second volume traveling along the first desired path. The droplet forming mechanism is positioned proximate the source. A first system selectively applies a first force to the source such that selected droplets formed from the source by the droplet forming mechanism travel along a second desired path. The first system is positioned proximate the source. A second system applies a second force to the droplets traveling along at least one of the first desired path and the second desired path. The second force is applied in a direction such that the droplets having the first volume diverge from the droplets having the second volume.

48 Claims, 14 Drawing Sheets

10
14
20
22,23
24b
24a
16
CONTROLLER
18
26
28
12
24

CONTINUOUS INK-JET PRINTING METHOD AND APPARATUS FOR CORRECTING INK DROP REPLACEMENT

FIELD OF THE INVENTION

This invention relates generally to the field of digitally controlled printing devices, and in particular to continuous inkjet printers in which a liquid ink stream breaks into droplets, some of which are selectively deflected. Either the deflected droplets or the non-deflected droplets can be printed on a print medium with the droplets having corrected print locations.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited.upon a medium. Typically, each technology requires separate ink delivery systems for each ink color used in printing. Ordinarily, the three primary subtractive colors, i.e. cyan, yellow and magenta, are used because these colors can produce, in general, up to several million perceived color combinations. In the construction of printers incorporating either technology, the printhead, typically, includes a plurality of nozzles arranged in a linear array. The printhead is typically scanned in a fast scan direction, substantially perpendicular to the row of nozzles, over a print medium. Additionally, the printhead may be stepped in a slow scan direction, substantially perpendicular to the fast scan direction, before the fast scan is repeated.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate. While heat actuators and piezoelectric actuators have been long used in drop-on-demand printing, they suffer from a lack of precise control of the placement of drops on the print medium, which is a critical parameter for image quality. With heat actuators, the nozzles or heaters may become contaminated due to thermally induced decomposition of ink, thereby causing drop misplacement errors. With piezoelectric actuators, the properties of the piezoelectric material may change with use and/or failure of the ink fluid meniscus to reproducibly engage the nozzle during each drop firing cause drop misplacement errors. In either case, highly visible artifacts may be produced particularly when misplacement errors occur repeatedly on the print medium. The artifacts are most apparent when the placement errors are perpendicular to the fast scan direction because the errors are repeated in a line. This type of image artifact is well known in the inkjet printer art.

U.S. Pat. No. 4,914,522 issued to Duffield et al., on Apr. 3, 1990 discloses a drop-on-demand ink jet printer that utilizes air pressure to produce a desired color density in a printed image. Ink in a reservoir travels through a conduit and forms a meniscus at an end of an inkjet nozzle. An air nozzle, positioned so that a stream of air flows across the meniscus at the end of the ink nozzle, causes the ink to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the ink dot size on the image remains constant while the desired color density of the ink dot is varied depending on the pulse width of the air stream.

The second technology, commonly referred to as "continuous stream" or "continuous" inkjet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

Typically, continuous inkjet printing devices are faster than droplet on demand devices. However, each color printed requires an individual droplet formation, deflection, and capturing system.

Conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control. As charged drops repel one another, drop placement accuracy suffers, particularly in a line parallel to the linear array of nozzles. The artifacts are most apparent when the placement errors are perpendicular to the fast scan direction because the errors are repeated in a line over a substantial distance on the recording medium. Examples of conventional continuous ink jet printers include U.S. Pat. No. 1,941,001, issued to Hansell, on Dec. 26, 1933; U.S. Pat. No. 3,373,437 issued to Sweet et al., on Mar. 12, 1968; U.S. Pat. No. 3,416,153, issued to Hertz et al., on Oct. 6; 1963; U.S. Pat. No. 3,878,519, issued to Eaton, on Apr. 15, 1975; and U.S. Pat. No. 4,346,387, issued to Hertz, on Aug. 24, 1982.

U.S. Pat. No. 3,709,432, issued to Robertson, on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets it does rely on the precise control of the break off points of the filaments and the placement of the air flow intermediate to these break off points. Such a system is difficult to control and to manufacture. Furthermore, the physical separation or amount of discrimination between the two droplet paths is small further adding to the difficulty of control and manufacture. As such, these printheads suffer from a lack of precise control of the placement of drops on the print medium which can produce visible image artifacts. Again, the artifacts are most apparent when the placement errors are perpendicular to the fast scan direction.

U.S. Pat. No. 4,190,844, issued to Taylor, on Feb. 26, 1980, discloses a continuous ink jet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time, being built up by repeated traverses of the printhead.

While this method does not rely on electrostatic means to affect the trajectory of droplets it does rely on the precise control and timing of the first ("open/closed") pneumatic deflector to create printed and non-printed ink droplets. Such a system is difficult to manufacture and accurately control resulting in at least the ink droplet build up discussed above. Furthermore, the physical separation or amount of discrimination between the two droplet paths is erratic due to the precise timing requirements increasing the difficulty of controlling printed and non-printed ink droplets resulting in poor ink droplet trajectory control. The erratic trajectories cause random errors in drop placement on the print medium which reduces image quality, while manufacturing defects cause systematic errors in drop placement. Both errors produce highly visible artifacts, particularly when the artifacts occur repeatedly over large distances on the print medium.

Additionally, using two pneumatic deflectors complicates construction of the printhead and requires more components. The additional components and complicated structure require large spatial volumes between the printhead and the media, increasing the ink droplet trajectory distance. Increasing the distance of the droplet trajectory decreases droplet placement accuracy and affects the print image quality. Again, there is a need to minimize the distance the droplet must travel before striking the print media in order to insure high quality images. Pneumatic operation requiring the air flows to be turned on and off is necessarily slow in that an inordinate amount of time is needed to perform the mechanical actuation as well as settling any transients in the air flow.

U.S. Pat. No. 6,079,821, issued to Chwalek et al., on Jun. 27, 2000, discloses a continuous inkjet printer that uses actuation of asymmetric heaters to create individual ink droplets from a filament of working fluid and deflect thoses ink droplets. A printhead includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher.

While the ink jet printer disclosed in Chwalek et al. works extremely well for its intended purpose, using a heater to create and deflect ink droplets increases the energy and power requirements of this device. This can cause ink to be thermally decomposed on the heaters resulting in ink contamination on or around the heater and/or nozzle. Ink contamination can reduce drop placement accuracy by interfering with the ink meniscus profile of the ejected ink stream and by altering the thermal efficiency of the heaters.

In both drop-on-demand and continuous ink jet printers, the visibility of artifacts caused by drop placement errors can be reduced by using only a portion of available nozzles chosen at random during each fast scan, as is practiced in currently available conventional ink jet printers. However, using random nozzles requires making many scans of the printhead over the same, or nearly the same, location on the print medium and thus reduces printer productivity.

For nozzles which are not defective, the paths of drops ejected from a row of equally spaced nozzles should be parallel. A defective nozzle eject drops whose path is not parallel to the paths of drops ejected from nozzles which are not defective. It is possible to determine whether nozzles are defective by viewing ejected drops from a direction perpendicular to the drop paths, that is by viewing from the fast scan direction. While it is possible to use conventional printheads and print using only the defective nozzles, this reduces printhead yield and greatly increases printhead cost. The problem is particularly acute for printheads having a very large number of nozzles.

It can be seen that there is a need to provide an inkjet printhead and printer of simple construction having reduced energy and power requirements and improved placement accuracy of individual ink drops on the recording medium. In particular, there is a need to provide an inkjet printhead and printer of simple construction with nozzles which can be operated in a way to avoid systematic drop misplacement errors by providing precise control of the placement of ink drops in the slow scan direction. Alternatively stated, there is a need to inexpensively provide a printhead having simplified control of individual ink droplets which ejects drops having paths of travel that are parallel when viewed from the fast scan printing direction.

SUMMARY OF THE INVENTION

It is an object of the present invention is to simplify construction of a continuous ink jet printhead and printer having improved placement accuracy of individual ink drops in order to render images of high quality.

Another object of the present invention is to reduce energy and power requirements of a continuous inkjet printhead and printer having improved placement accuracy of individual ink drops in the slow scan direction.

Yet another object of the present invention is to provide a continuous ink jet printhead and printer capable of rendering high resolution images with reduced image artifacts using large volumes of ink.

Yet another object of the present invention is to improve the reliability of a continuous ink jet printhead.

Yet another object of the present invention is to simplify construction and operation of a continuous ink jet printer suitable for printing high quality images having reduced artifacts due to systematic errors of drop placement.

Yet another object of the present invention is to provide a continuous ink jet printhead and printer capable of printing images having reduced image artifacts with a wide variety of inks on a wide variety of materials.

According to a feature of the present invention, an apparatus for printing an image includes a source of ink. A droplet forming mechanism is operable in a first state to form droplets from the source having a first volume traveling along a first desired path and in a second state to form droplets from the source having a second volume traveling along the first desired path. The droplet forming mechanism is positioned proximate the source. A first system selectively applies a first force to the source such that selected droplets formed from the source by the droplet forming mechanism travel along a second desired path. The first system is positioned proximate the source. A second system applies a second force to the droplets traveling along at least one of the first desired path and the second desired path. The second force is applied in a direction such that the droplets having the first volume diverge from the droplets having the second volume.

According to another feature of the present invention, a printhead includes a droplet forming mechanism is operable in a first state to form droplets having a first volume traveling along a first desired path and in a second state to form droplets having a second volume traveling along the first desired path. A droplet steering system is positioned relative to the droplet forming mechanism which selectively applies a first force to the droplets formed from the source such that selected droplets formed from the source travel along a second desired path. A droplet deflector system is positioned relative to the droplet forming mechanism which applies a second force to the droplets traveling along at least one of the first desired path and the second desired path. The second force is applied in a direction such that the droplets having the first volume diverge from at least one of the first desired path and the second desired path.

According to another feature of the present invention, an inkjet printer includes a source of ink. A printhead having a droplet forming mechanism is operable in a first state to form droplets from the source having a first volume traveling along a desired path and in a second state to form droplets from the source having a second volume traveling along the desired path. A droplet steering system is positioned relative to the droplet forming mechanism which selectively applies a first force to the droplets formed from the source such that the droplets formed from the source travel along a second desired path. A droplet deflector system is positioned relative to the droplet forming mechanism which applies a second force to the droplets traveling along at least one of the first desired path and the second desired path. The second force is applied in a direction such that the droplets having the first volume diverge from at least one of the first desired path and the second desired path.

According to another feature of the present invention, a method of printing an image having corrected ink droplet placement includes forming droplets having a first volume traveling along a first desired path; forming droplets having a second volume traveling along the first desired path; causing the droplets having the first volume to diverge from the first desired path; collecting the droplets having one of the first volume and the second volume; allowing the droplets having the other of the first volume and the second volume to impinge upon a recording media; determining when the droplets having one of the first volume and the second volume begin traveling along an undesired path; and correcting the droplets having one of the first volume and the second volume such that the droplets resume traveling along the desired path.

According to another feature of the present invention, a method of correcting droplet placement error in a plurality of nozzles aligned in a row includes forming droplets from a first nozzle traveling along a first desired path; forming droplets from a second nozzle traveling along a second desired path, the second desired path being substantially parallel to the first desired path as viewed in a direction perpendicular to the row and perpendicular to a fast scan direction; determining when the second desired path is other than parallel to the first desired path; and causing the second desired path to resume being parallel to the first desired path.

BRIEF DESCRIPTION OF THE DRAWINGS

Other features and advantages of the present invention will become apparent from the following description of the preferred embodiments of the invention and the accompanying drawings, wherein:

FIG. 21 is a schematic side view of a printhead having uncorrected ink drop travel paths;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1A, 1B:
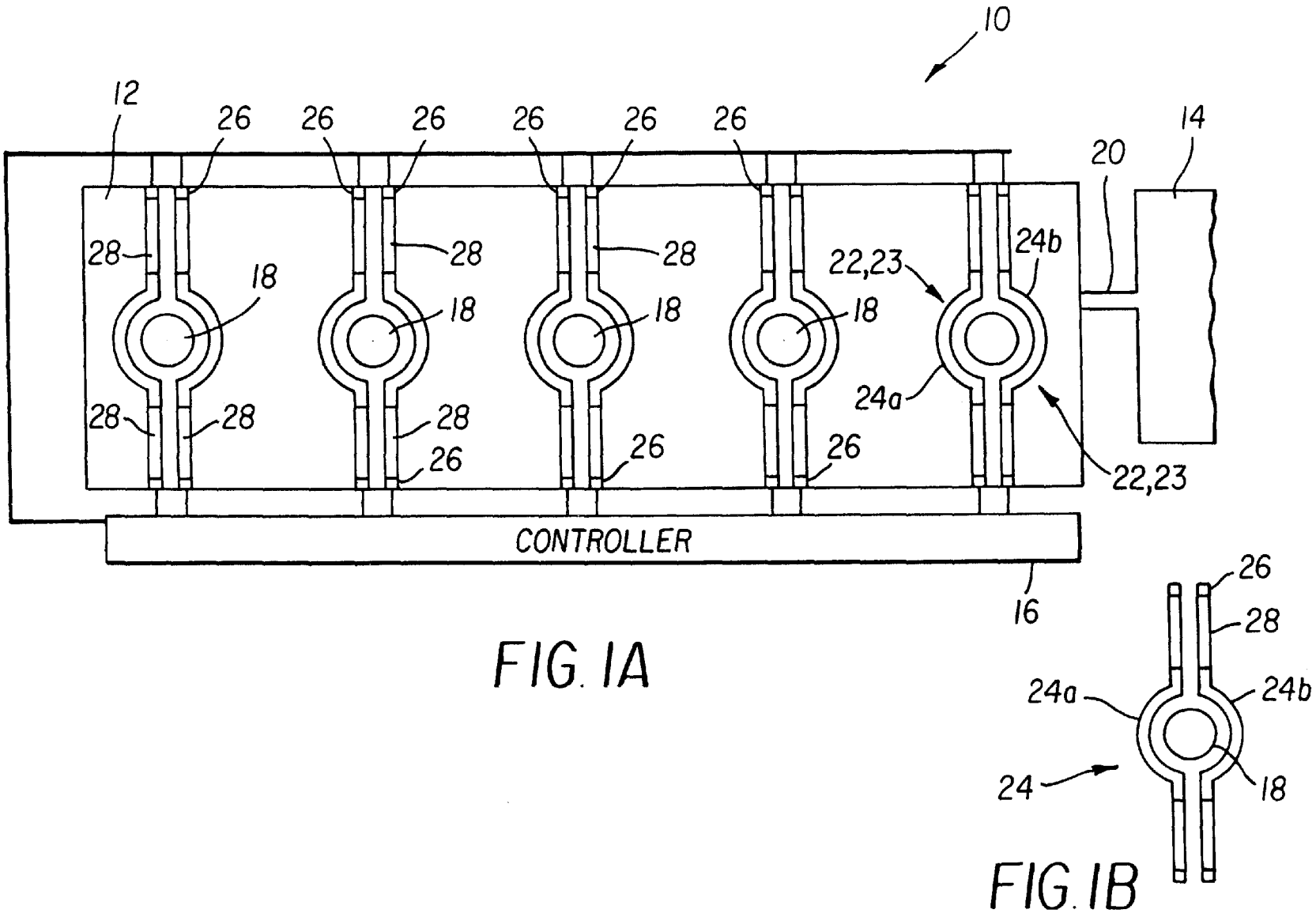
FIG. 1A is a schematic plan view of a printhead made in accordance with a preferred embodiment of the present invention.
FIG. 1B is a schematic plan view of a component of the printhead shown in FIG. 1A.

Referring to FIG. 1A, an integrated printhead 10 of a preferred embodiment of the present invention is shown. Integrated printhead 10 includes a printhead 12, at least one ink supply 14, and a controller 16. Although integrated printhead 10 is illustrated schematically and not to scale for the sake of clarity, one of ordinary skill in the art will be able to readily determine the specific size and interconnections of the elements of the preferred.

In a preferred embodiment of the present invention, printhead 12 is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and, therefore within the scope of this disclosure, that printhead 12 may be formed from any materials using any fabrication techniques conventionally known in the art.

Again referring to FIG. 1A, at least one nozzle 18 is formed on printhead 12. Nozzle 18 is in fluid communication with ink supply 14 through an ink passage 20 also formed in printhead 12 and/or connected to printhead 12. It is specifically contemplated, therefore within the scope of this disclosure, that printhead 12 may incorporate additional ink supplies and corresponding nozzles 18 in order to provide color printing using three or more primary ink colors. Additionally, black and white or single color printing may be accomplished using a single ink supply 14 and nozzle 18.

Ink droplet forming mechanism 22 and ink droplet steering mechanism 23 are formed or positioned on printhead 12 around a corresponding nozzle 18. In a preferred embodiment, ink droplet forming mechanism 22 and ink droplet steering mechanism 23 are the same mechanism and comprise a split heater 24, at least partially formed or positioned on printhead 12 around a corresponding nozzle 18, having a first side 24*a* and a second side 24*b*, as shown in detail in FIG. 1B. Although split heater 24 may be disposed radially away from an edge of corresponding nozzle 18, split heater 24 is preferably disposed close to corresponding nozzle 18 in a concentric manner. In a preferred embodiment, split heater 24 is formed in a substantially circular or ring shape. In an alternative preferred embodiment, shown in FIG. 1C, split heater 24 has a rectangular first side 24*a* and rectangular second side 24*b*. However, it is specifically contemplated, and therefore within the scope of this disclosure, that split heater 24 may be formed in a partial segmented ring, square, etc. Split heater 24 is made of an electric resistive material, for example a thin film material such as titanium nitride, and is connected to electrical contact pads 26 via conductors 28. Split heater 24 may deposited by well known techniques of thin film deposition and patterning, such as evaporation, sputtering, photolithography, and etching.

Conductors 28 and electrical contact pads 26 may be at least partially formed or positioned on printhead 12 and provide an electrical connection between controller 16 and split heater 24. Alternatively, the electrical connection between controller 16 and split heater 24 may be accomplished in any well-known manner. Additionally, controller 16 may be a relatively simple device (a power supply for split heater 24, etc.) or a relatively complex device (logic controller, programmable microprocessor, etc.) operable to control many components (split heater 24, integrated printhead 10, print drum 80, etc.) in a desired manner.

Although in a preferred embodiment ink droplet forming mechanism 22 and ink droplet steering mechanism 23 are the same mechanism, it is specifically contemplated and therefore within the scope of this invention, that ink droplet forming mechanism 22 and ink droplet steering mechanism 23 can be separate distinct mechanisms. For example, ink droplet forming mechanism 22 can be a piezoelectric actuator while ink droplet steering mechanism is a heater; ink droplet forming mechanism can also be a piezoelectric actuator while ink droplet steering mechanism is an electrostatic deflection device; ink droplet forming mechanism can be a heater while ink droplet steering mechanism can be an electrostatic deflection device; etc.

Figure 2A:
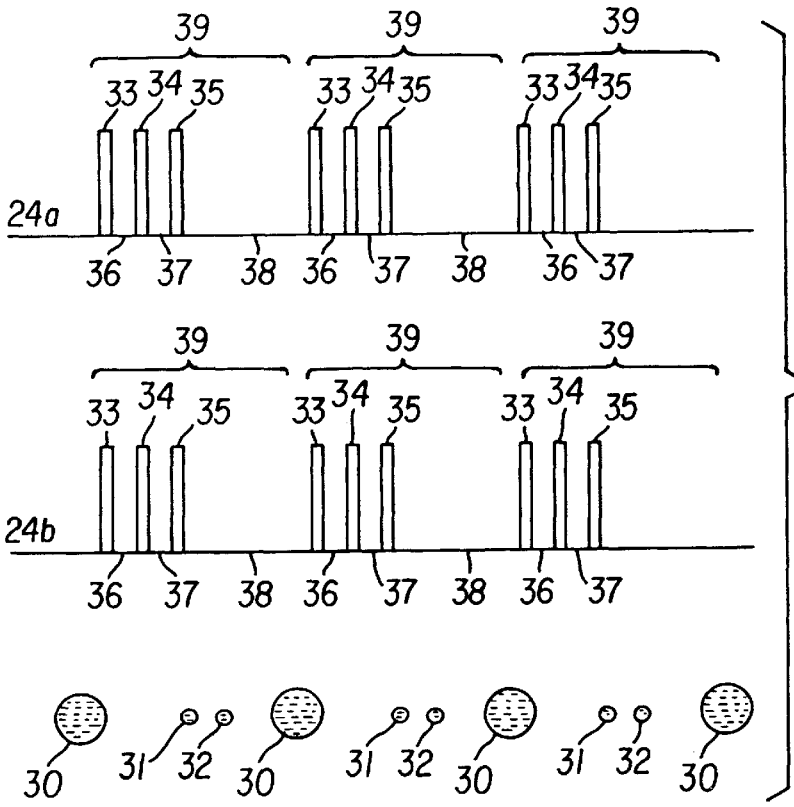
FIGS. 2A through 2D are diagrams illustrating a frequency control of a heater used in the embodiments shown in FIGS. 1A–1C and the resulting ink droplets.

Referring to FIG. 2A, an example of the electrical activation waveform provided by controller 16 to split heater 24 is shown generally in FIG. 2A. The electrical activation waveform labeled 24*a* in FIG. 2A, applied to the first side 24*a* of split heater 24, is shown as a function of time (horizontal axis). The vertical height of the electrical activation waveform corresponds to the amplitude of the voltage applied to first side 24*a*. The electrical activation waveform labeled 24*b* in FIG. 2A, applied to the second side 24*b* of split heater 24, is also shown as a function of time (horizontal axis). The vertical height of the electrical activation waveform similarly corresponds to the amplitude of the voltage applied to second side 24*b*. The time axes are the same for both electrical activation waveforms. Individual ink droplets 30, 31, and 32, resulting from the ejection of ink from nozzle 18 and this actuation of split heater 24, are shown schematically at the bottom of FIG. 2A. A high frequency of activation of split heater 24 results in small volume droplets 31, 32, while a low frequency of activation of split heater 24 results in large volume droplets 30. The drops are spaced in time as they are ejected from nozzle 18 according to the same time axes of the electrical waveforms. In FIG. 2A, the amplitude and timing of both electoral activation waveforms labeled 24*a* and 24*b* are identical or substantially identical.

In a preferred implementation, which allows for the printing of multiple droplets per image pixel, a time 39 associated with printing of an image pixel includes time sub-intervals reserved for the creation of small printing droplets 31, 32 plus time sub-intervals for creating one larger non-printing droplet 30. In FIG. 2A only time for the creation of two small droplets 31, 32 is shown for simplicity of illustration, however, it should be understood that the reservation of more time for a larger number of small droplets is clearly within the scope of this invention.

When printing each image pixel, large droplet 30 is created through the activation of split heater 24 with electrical pulse time 33, typically from 0.1 to 10 microseconds in duration, and more preferentially 0.5 to 1.5 microseconds. The additional (optional) activation of split heater 24, after delay time 36, with an electrical pulse 34 is conducted in accordance with image data wherein at least one small droplet is required. When image data requires another small droplet be created, split heater 24 is again activated after delay 37, with a pulse 35. In this example, small droplets 31, 32 are printed while large droplet 30 is guttered.

Heater activation electrical pulse times 33, 34, and 35 are substantially similar, as are delay times 36 and 37. Delay times 36 and 37 are typically 1 to 100 microseconds, and more preferentially, from 3 to 6 microseconds. Delay time 38 is the remaining time after the maximum number of small droplets have been formed and the start of electrical pulse time 33, concomitant with the beginning of the next image pixel with each image pixel time being shown generally at 39. The sum of split heater 24 electrical pulse time 33 and delay time 38 is chosen to be significantly larger than the sum of a heater activation time 34 or 35 and delay time 36 or 37, so that the volume ratio of large droplets to small droplets is preferentially a factor of four (4) or greater. It is apparent that split heater 24 activation may be controlled independently based on the ink color required and ejected through corresponding nozzle 18, movement of printhead 12 relative to a print medium, and an image to be printed. It is specifically contemplated, and therefore within the scope of this disclosure that the absolute volume of the small droplets 31 and 32 and the large droplets 30 may be adjusted based upon specific printing requirements such as ink and media type or image format and size. As such, reference below to large volume non-printed droplets 30 and small volume printed droplets 31 and 32 is relative in context for example purposes only and should not be interpreted as being limiting in any manner.

Figure 2B:
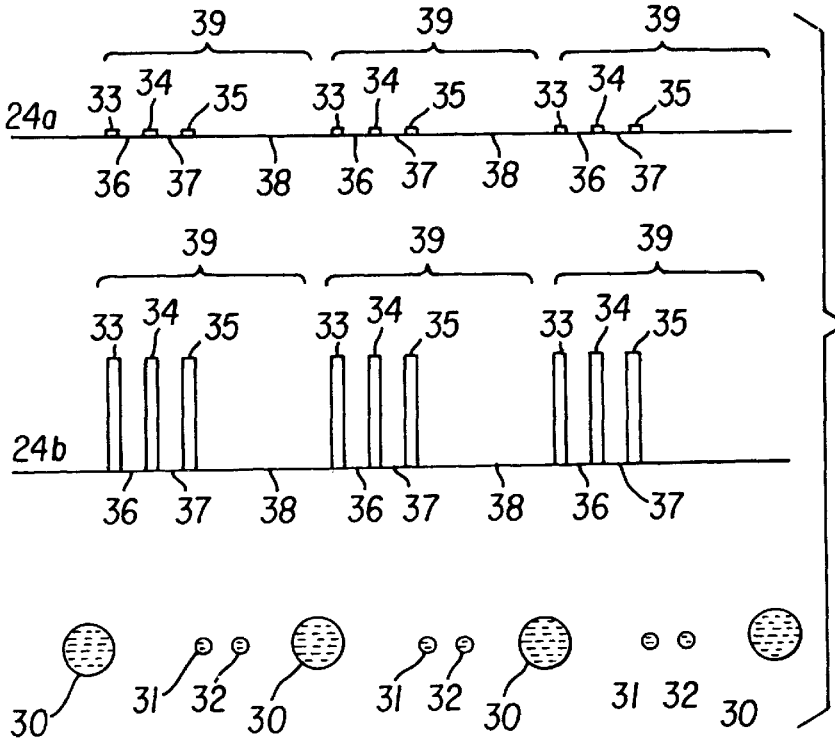

Referring to FIG. 2B, a second example of an electrical activation waveform provided by controller 16 to split heater 24 is shown. The electrical activation waveform labeled 24*a* in FIG. 2B, applied to the first side 24*a* of split heater 24 and the electrical activation waveform labeled 24*b* in FIG. 2B applied to the second side 24*b* of split heater 24, are shown as a function of time (horizontal axes). The vertical heights of the electrical activation waveforms correspond to the amplitudes of the voltages applied to first side 24*a* and to second side 24*b*. Individual ink droplets 30, 31, and 32 resulting from the ejecting of ink from nozzle 18, in combination with this heater actuation, are shown schematically at the bottom of FIG. 2B. However, in the case of FIG. 2B, the amplitudes of the electrical activation waveforms labeled 24*a* and 24*b* are not identical; specifically, the electrical activation waveforms labeled 24*a* in FIG. 2B differs from that shown in FIG. 2A in that its amplitude is very nearly zero. In practice, the results do not differ when the amplitude of the electrical activation waveforms labeled 24*a* in FIG. 2B is made exactly zero. The timing of the pulses of the electrical activation waveforms is unchanged from the timing shown in FIG. 2A. Nonetheless, we have discovered that the size and spacing of individual ink droplets 30, 31, and 32 resulting from the ejection of ink from nozzle 18 in response to the electrical activation waveforms of FIG. 2B remain essentially the same when compared to those corresponding to the case of FIG. 2A. A high frequency of activation of split heater 24 results in small volume droplets 31, 32, while a low frequency of activation of split heater 24 results in large volume droplets 30. The drops are spaced in time as they are jetted from nozzle 18 according to the same time axes of the electrical waveforms.

As in the case of FIG. 2A, in a preferred implementation, which allows for the printing of multiple droplets per image pixel, a time 39 associated with printing of an image pixel includes time sub-intervals reserved for the creation of small droplets 31, 32 plus time sub-intervals for creating one larger non-printing droplet 30. In FIG. 2B, only time for the creation of two small printing droplets 31, 32 is shown for simplicity of illustration, however, it should be understood that the reservation of more time for a larger number of small droplets is clearly within the scope of this invention.

Also, as in the case of FIG. 2A, when printing each image pixel, large droplet 30 is created through the activation of split heater 24 with electrical pulse time 33, typically from 0.1 to 10 microseconds in duration, and more preferentially 0.5 to 1.5 microseconds. The additional (optional) activation of split heater 24, after delay time 36, with an electrical pulse 34 is conducted in accordance with image data wherein at least one small droplet is required. When image data requires another small droplet be created, split heater 24 is again activated after delay 37, with a pulse 35. In this example, small droplets 31, 32 are printed while large droplet 30 is guttered.

Heater activation electrical pulse times 33, 34, and 35 are substantially similar, as are delay times 36 and 37. Delay times 36 and 37 are typically 1 to 100 microseconds, and more preferentially, from 3 to 6 microseconds. Delay time 38 is the remaining time after the maximum number of small droplets have been formed and the start of electrical pulse time 33, concomitant with the beginning of the next image pixel with each image pixel time being shown generally at 39. The sum of split heater 24 electrical pulse time 33 and delay time 38 is chosen to be significantly larger than the sum of a heater activation time 34 or 35 and delay time 36 or 37, so that the volume ratio of large droplets to small droplets is preferentially a factor of four (4) or greater. It is apparent that split heater 24 activation may be controlled independently based on the ink color required and ejected through corresponding nozzle 18, movement of printhead 12 relative to a print medium, and an image to be printed. It is specifically contemplated, and therefore within the scope of this disclosure that the absolute volume of the small droplets 31 and 32 and the large droplets 30 may be adjusted based upon specific printing requirements such as ink and media type or image format and size. As such, reference below to large volume non-printed droplets 30 and small volume printed droplets 31 and 32 is relative in context for example purposes only and should not be interpreted as being limiting in any manner.

Figure 2C:
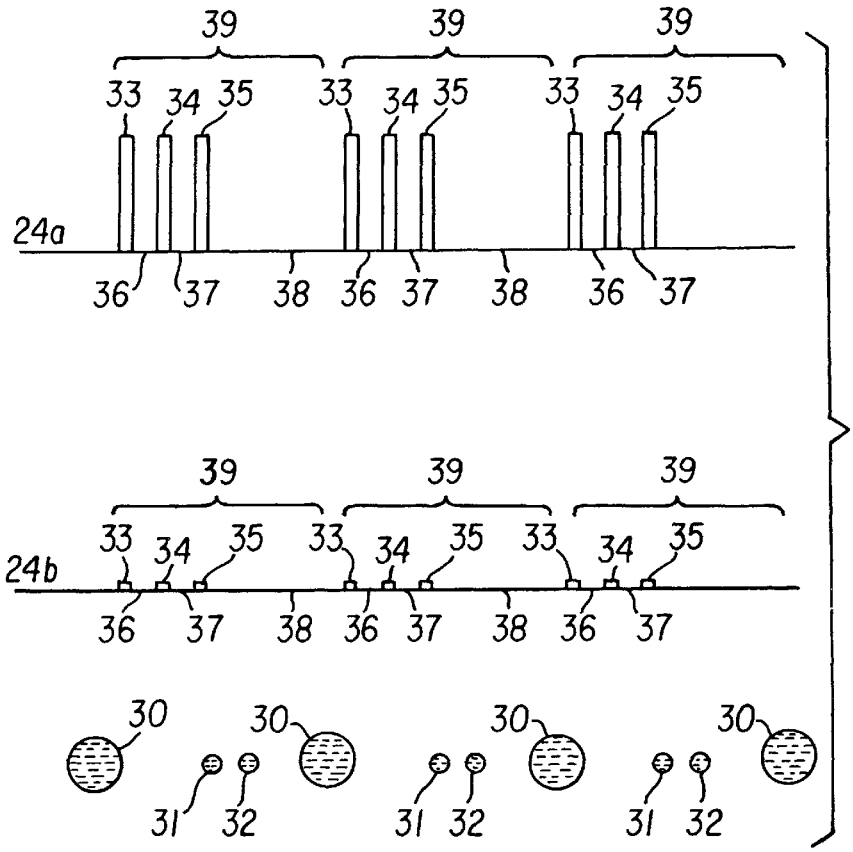

Referring to FIG. 2C, a third example of an electrical activation waveform provided by controller 16 to split heater 24 is shown. The electrical activation waveform labeled 24*a* in FIG. 2C, applied to the first side 24*a* of split heater 24 and the electrical activation waveform labeled 24*b* in FIG. 2C applied to the second side 24*b* of split heater 24, are shown as a function of time (horizontal axes). The vertical heights of the electrical activation waveforms correspond to the amplitudes of the voltages applied to first side 24*a* and to second side 24*b*. Individual ink droplets 30, 31, and 32 resulting from the jetting of ink from nozzle 18, in combination with this heater actuation, are shown schematically at the bottom of FIG. 2C. However, in the case of FIG. 2B, the amplitudes of the electoral activation waveforms labeled 24*a* and 24*b* are not identical; specifically, the electoral activation waveforms labeled 24*b* in FIG. 2C differs from that shown in FIG. 2A in that its amplitude is very nearly zero. The timing of the pulses of the electoral activation waveforms is unchanged from the timing shown in FIG. 2A. Nonetheless, we have discovered that the size and spacing of individual ink droplets 30, 31, and 32 resulting from the ejection of ink from nozzle 18 in response to the electoral activation waveforms of FIG. 2C remain essentially identical to those corresponding to the cases of FIGS. 2A and 2B. A high frequency of activation of split heater 24 results in small volume droplets 31, 32, while a low frequency of activation of split heater 24 results in large volume droplets 30. Again, the results do not differ when the amplitude of the electoral activation waveforms labeled 24*b* in FIG. 2C is made exactly zero.

As in the case of FIG. 2A, in a preferred implementation, which allows for the printing of multiple droplets per image pixel, a time 39 associated with printing of an image pixel includes time sub-intervals reserved for the creation of small droplets 31, 32 plus time for creating one larger droplet 30.

Figure 2D:
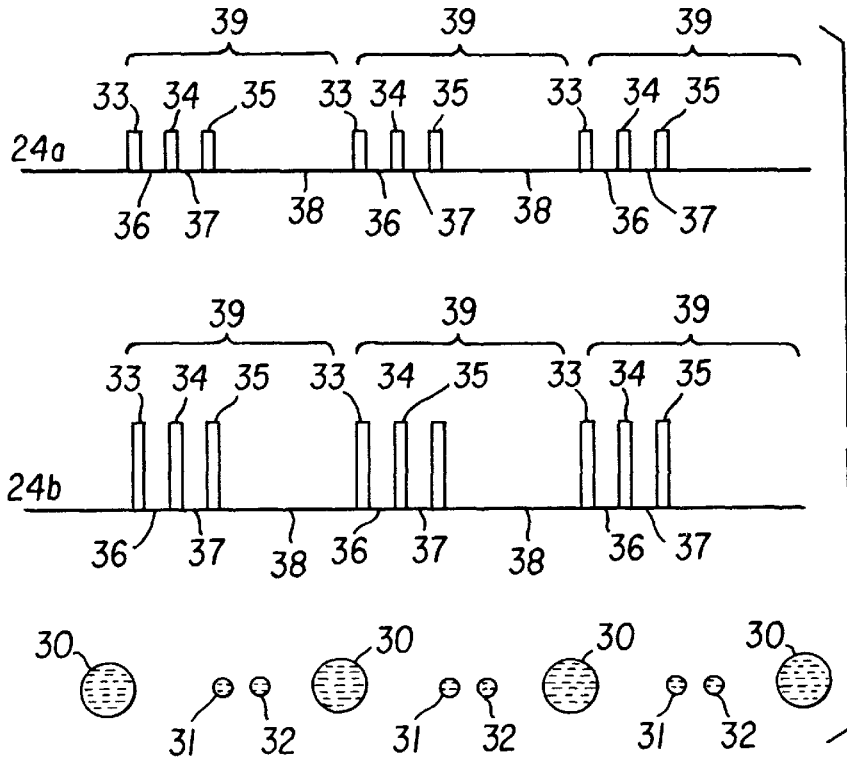

Referring to FIG. 2D, a fourth example of an electrical activation waveform provided by controller 16 to split heater 24 is shown. The electrical activation waveforms 24*a* and 24*b* are shown as a function of time (horizontal axes), and individual ink droplets 30, 31, and 32 resulting from the ejection of ink from nozzle 18, in combination with this actuation of heater 24, are shown schematically at the bottom of FIG. 2D. However, in the case of FIG. 2D, the amplitudes of the electoral activation waveforms labeled 24*a* and 24*b* are both reduced from those shown in FIG. 2A, that of the electoral activation waveform labeled 24*a* by 70% and that of the of the electoral activation waveform labeled 24*b* by 30%. The timing of the pulses of electoral activation waveforms are unchanged from the timing shown in FIG. 2A. Again, we have discovered that the size and spacing of individual ink droplets 30, 31, and 32 resulting from the jetting of ink from nozzle 18 in responds to the electoral activation waveforms of FIG. 2C remain essentially identical to those corresponding to the cases of FIGS. 2A and 2B. A high frequency of activation of split heater 24 results in small volume droplets 31, 32, while a low frequency of activation of split heater 24 results in large volume droplets 30. This result is essentially the same so long as the sum of the amplitudes of the waveforms is at least one half the sum of the amplitudes of the waveforms shown in FIG. 2A.

As in the case of FIG. 2A, in a preferred implementation, which allows for the printing of multiple droplets per image pixel, a time 39 associated with printing of an image pixel includes time sub-intervals reserved for the creation of small printing droplets 31, 32 plus time sub-intervals for creating one larger non-printing droplet 30.

Although the drop volumes, spacings, velocities etc. provided by droplet forming mechanism 22 and droplet steering mechanism 23 controlled by controller 16 are observed to be essentially identical in all the cases associated with the different electrical activation waveforms shown in FIGS. 2A–2D; in accordance with the present invention, droplets ejected using different electrical activation waveforms of FIGS. 2A–2D differ in their printed positions in a direction substantially parallel to the direction defined by the row of nozzles on integrated printhead 10. In the examples of FIGS. 1A–2D, this is in the slow scan direction. Thereby, by controlling the electrical activation waveforms, for example by using controller 16, the printed positions of droplets can be controlled in slow scan direction. More generally stated, in accordance with the present invention, the drops provided by integrated printhead 10 can be printed in different positions in a direction parallel to a steering direction of droplet steering mechanism 23. These positions depend on the electrical activation waveforms.

The ability to print droplets in different positions comes from the action of the droplet steering mechanism 23, which causes angulation of the droplet path or trajectory along the steering direction. Thereby, in conjunction with controller 16, the paths of drops ejected from nozzles 18 can be controlled. For example, the paths of drops ejected from nozzles 18 can be controlled to be parallel when viewed along the fast scan direction.

Figure 1C:
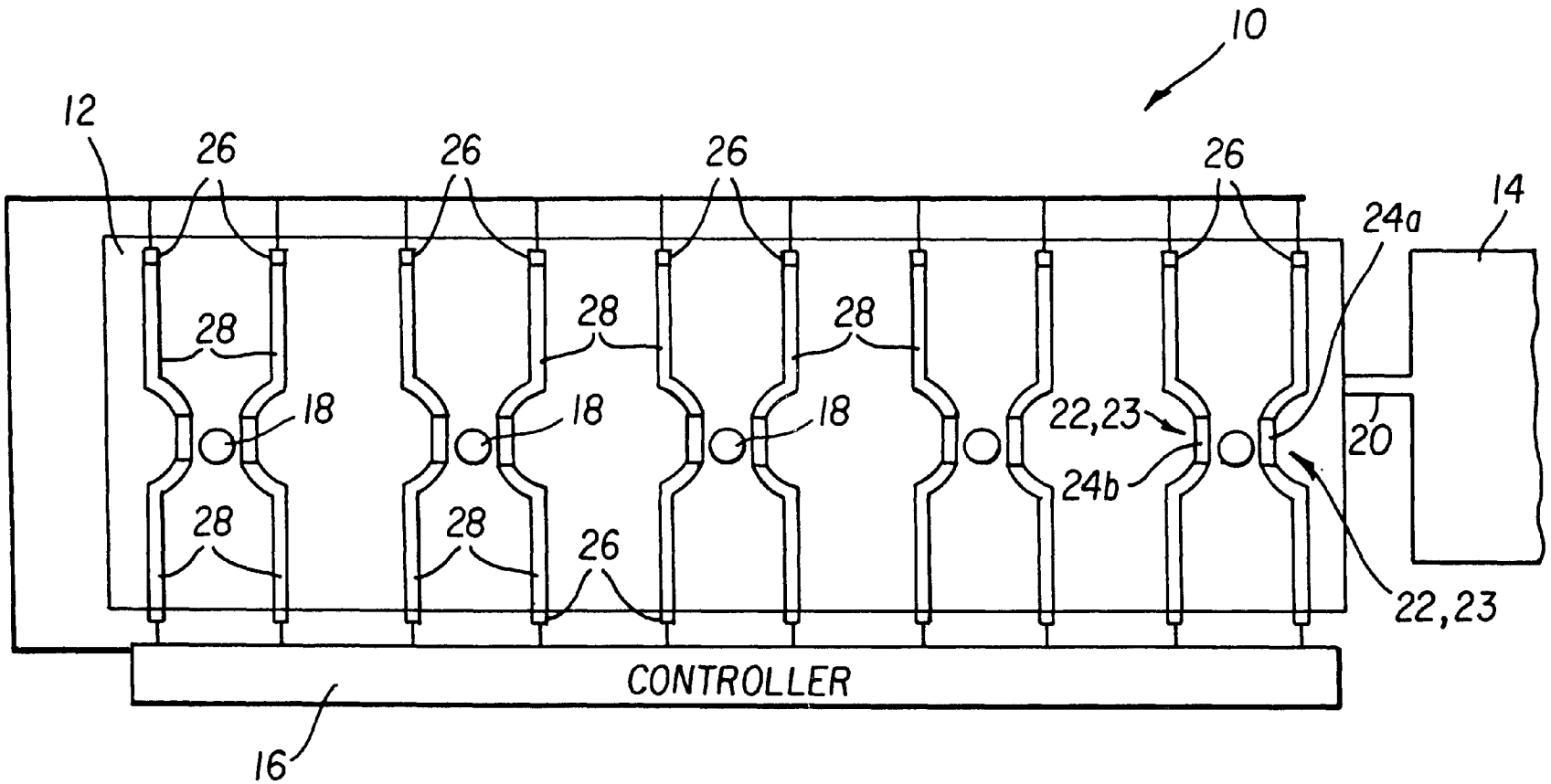
FIG. 1C is a schematic plan view of an alternative embodiment of the printhead shown in FIG. 1A.

In the preferred embodiment, droplet forming mechanism 22 and droplet steering mechanism 23 comprise split heater 24, as shown in FIGS. 1A–1C. The trajectories of jetted drops are steered in a horizontal direction in FIGS. 1A–1C and in FIGS. 2E–2J because the droplet steering mechanism steers drops in this direction. Hence the positions of droplets on the recording medium are controlled in a line parallel to the row of nozzles, that is in the slow scan direction. The steering direction of split heater 24 is perpendicular to its axis of symmetry, and thus the steering direction would change if for example, split heater 24 is rotated in FIG. 1A. More generally stated, the steering direction of droplets and thus the direction in which droplets can be controllable positioned by the steering mechanism on the recording medium is parallel to a line between corresponding portions of the first side 24*a* and second side 24*b* of split heater 24.

The differences in the trajectories of drops jetted from nozzles 18 of integrated printhead 10 are shown in FIGS. 2E–2H, which illustrate droplet trajectories corresponding to the waveforms of FIGS. 2A–2D, viewed from the fast scan direction. In discussing FIGS. 1A–2D, it is assumed that the fast scan direction is perpendicular to the row of nozzles 18, and that the nozzles are equally spaced, although this need not be the case.

Figure 2E:
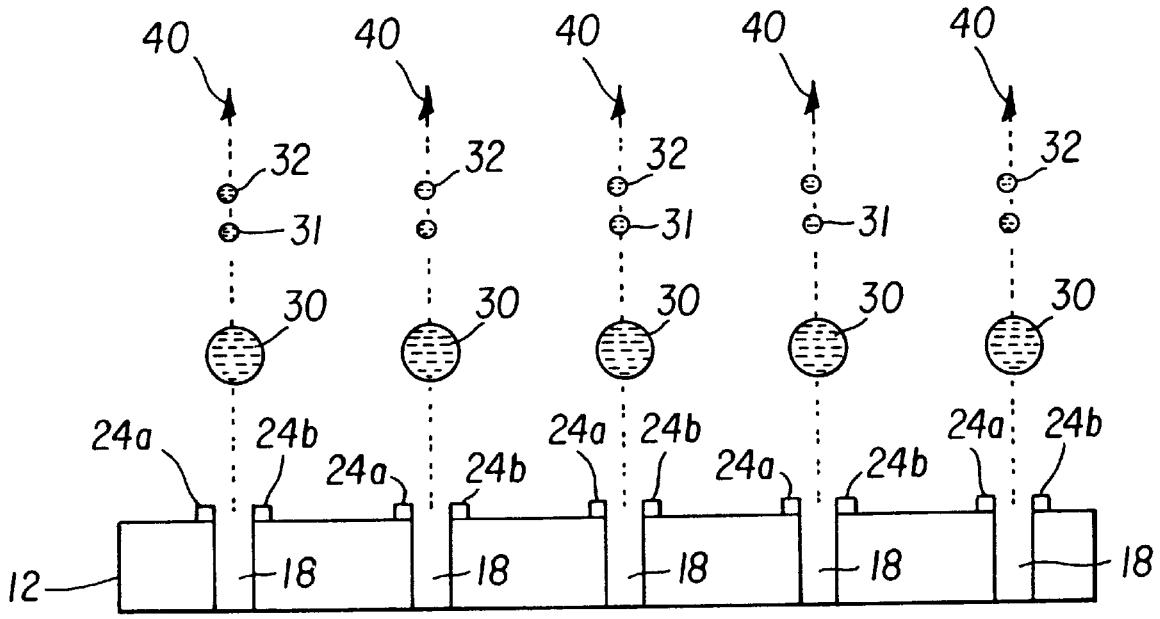
FIGS. 2E through 2H are diagrams illustrating ink drop travel paths using the frequency control diagrams shown in FIGS. 2A–2D.

In FIGS. 2E–2H nozzles eject droplets in desired directions to one another, that is no nozzles eject drops that are misdirected, for example due to manufacturing defects. The drop trajectories are all shown vertically in FIGS. 2E–FIG. 2H. FIG. 2E shows a fast-scan view of desired trajectories 40 of large and small drops 30, 31, 32 ejected from nozzles 18. FIG. 2E corresponds to the case of electrical activation waveforms applied to the first side 24*a* and to the second side 24*b* of split heater 24 shown in FIG. 2A.

Figure 2F:
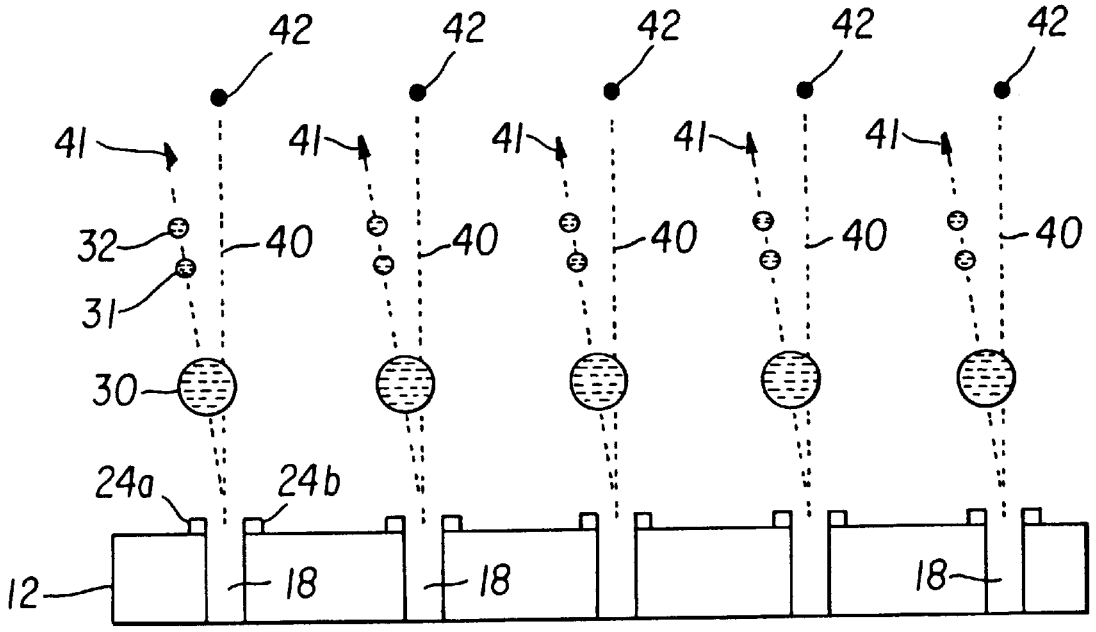

FIG. 2F shows trajectories 41 of large and small drops 30, 31, 32 ejected from nozzles 18, again for case of all nozzles ejecting drops in similar directions to one another, as viewed from the fast scan direction for the electrical activation of FIG. 2B. In particular, the electrical activation waveforms applied to the first side 24*a* and to the second side 24*b* of split heater by controller 16 cause displacement of the printed drops to the left of the print location obtained from an identical electrical activation waveform provided by controller 16, because the trajectories are angled. The vertical dotted line in FIGS. 2F–2I show the drop trajectories shown in FIG. 2E.

Figure 2G:
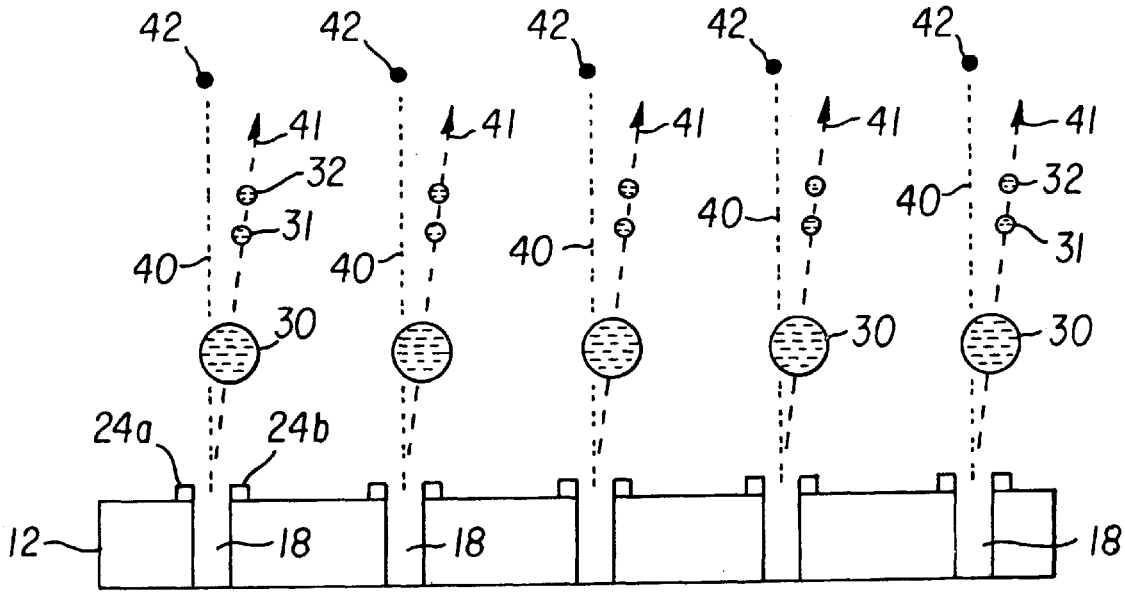

FIG. 2G shows the fast-scan view of trajectories 41 of large and small drops 30, 31, 32 ejected from nozzles 18, again for case of all nozzles ejecting drops in similar directions for the electrical activation of FIG. 2C. In particular, the electrical activation waveforms applied to the first side 24*a* and to the second side 24*b* of split heater by controller 16 cause displacement of the printed drops to the right of print location 42 obtained from an identical electrical activation waveform provided by controller 16, because the trajectories 41 are angled. Again, the vertical dotted line in FIGS. 2F–2I is shown the drop trajectories 40 in FIG. 2E.

Figure 2H:
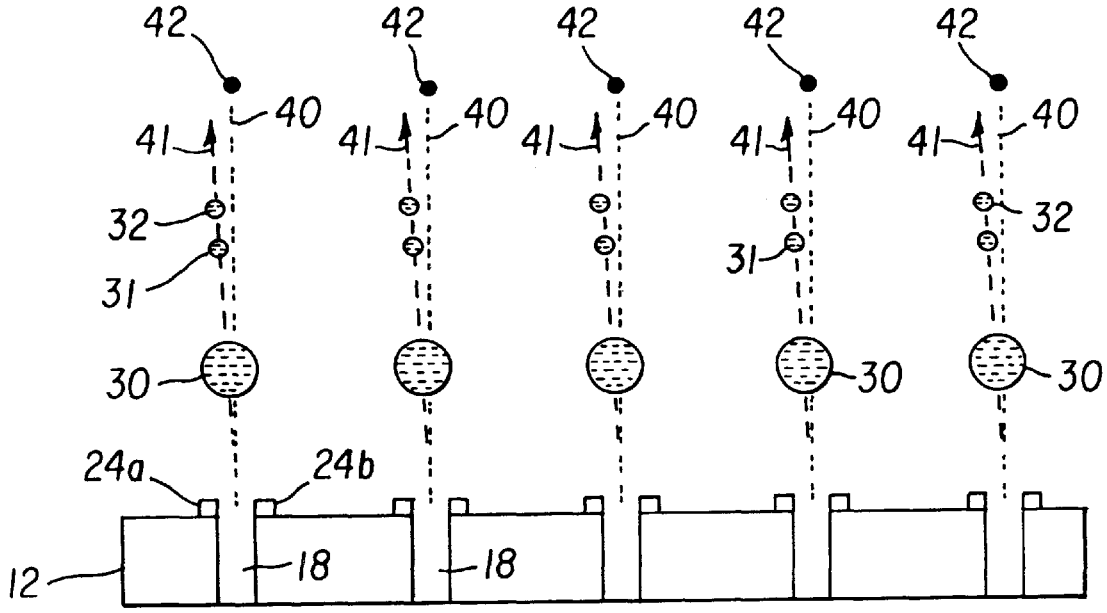

FIG. 2H shows the fast-scan view of the trajectories of large and small drops 30, 31, 32 ejected from nozzles 18 for the electrical activation of FIG. 2D. The electrical activation waveforms applied to the first side 24*a* and to the second side 24*b* of split heater by controller 16 cause displacement of the printed drops to the left of the print location obtained from an identical electrical activation waveform provided by controller 16, but the displacement to the left is not as great as that in FIG. 2F because the waveforms applied to the first side 24*a* and to the second side 24*b* of split heater are more nearly equal in amplitude. In general, we find that the amount of drop displacement in the slow scan direction depends on the difference in electrical activation waveforms applied to the first side 24*a* and to the second side 24*b* of split heater. This allows the controller to control drop placement in the slow scan direction differently for drops ejected by different nozzles 18 by controlling the electrical activation waveforms for each nozzle.

In particular, if drops from one or more nozzles 18 are found to be systematically misaligned, for example, drops being misaligned in a slow scan direction on a recording medium, for example, due to a nozzle defect, controller 16 can control the electrical activation waveforms applied to droplet steering mechanism 23 (either of the first and second sides 24*a* and 24*b* of the split heaters 24, etc.) of the misaligned nozzles so that for each misaligned nozzle, the drop trajectory is caused to be the desired trajectory and the misalignment is corrected.

Figure 2I:
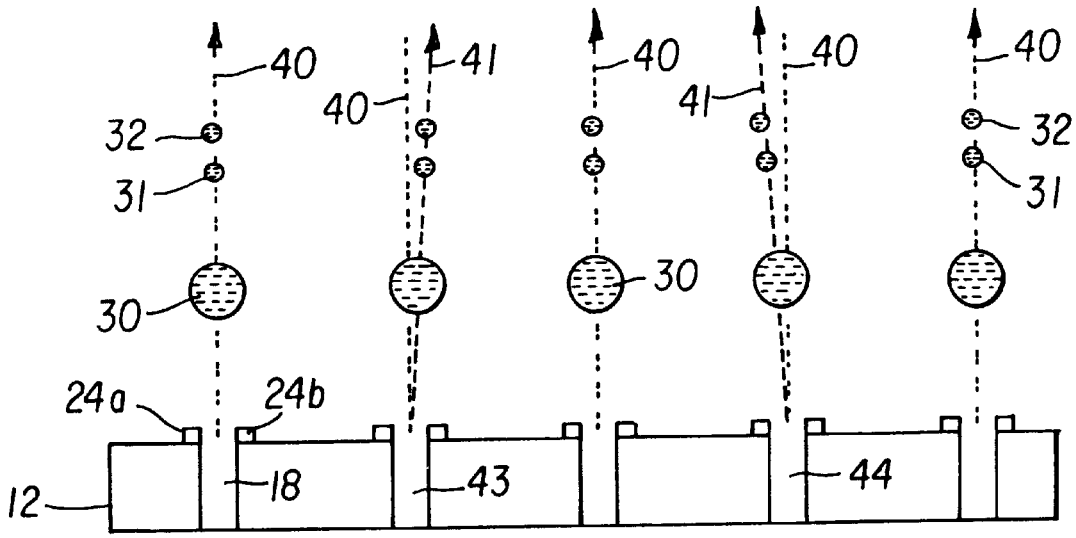
FIG. 2J is a schematic side view of a printhead having corrected ink drop travel paths.
FIGS. 2K–2Q are alternative diagrams illustrating a frequency control of a heater used in the embodiments shown in FIGS. 1A–1C and the resulting ink droplets.
Figure 2J:
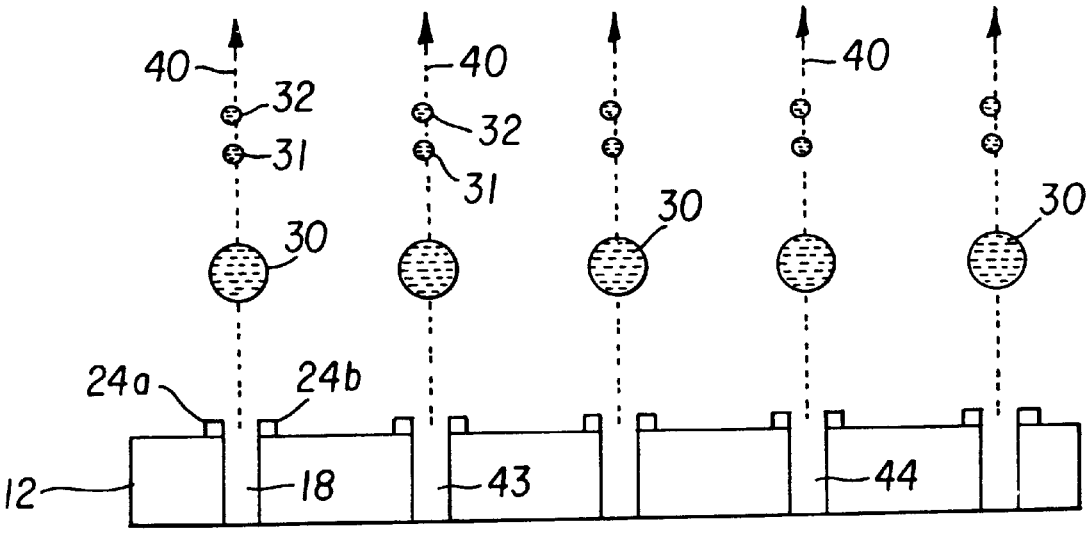

Correction of misalignment is illustrated in FIGS. 2I and 2J. In FIG. 2I, corresponding to a case in which the electrical activation waveforms applied to the first and second sides 24*a* and 24*b* of the split heaters 24 are identical for all nozzles, a nozzle 43 is misaligned and is shown ejecting drops angled to the right, whereas a nozzle 44 is misaligned and ejecting drops angled to the left by a somewhat larger amount. The desired trajectories 40 in FIG. 2I is vertical.

In FIG. 2J, the misalignment of nozzle 43 and 44 has been corrected by altering the electrical activation waveforms applied to the first and second sides 24*a* and 24*b* of the split heaters to nozzles 43 and 44. Specifically, nozzle 43 has been given a waveform similar to that illustrated in FIG. 2H, where as nozzle 44 has been given a waveform similar to that illustrated in FIG. 2F, since the waveforms in FIGS. 2H and 2F angle the trajectories of jetted drops left and right respectively.

Advantageously, in accordance with the present invention, correcting misalignment using droplet steering mechanism 23 does not alter the size, spacing, velocity etc. of the drops formed by the droplet forming mechanism 22. Therefore, even when droplet forming mechanism 22 and droplet steering mechanism 23 comprise an identical physical structure, as in the preferred embodiment, their functions of forming and steering drops can be performed independently of one another.

As droplet formation and droplet steering can both be accomplished even when the electrical activation waveform of either the first or the second side 24*a*, 24*b* of split heater 24 is zero, either sides 24*a*, 24*b* or both can provide droplet formation as well as droplet steering. However, this method of operation is not required. Specifically, it is not required that the electrical activation waveforms applied to the first and second sides 24*a* and 24*b* of the split heaters 24 differ only in amplitude. In an alternative embodiment, the electrical activation waveforms differ in shape and are selected to perform separate functions in the sense that the function of droplet formation is provided only by electrical activation waveforms applied to first side 24*a* of split heater 24 and the function of droplet steering is provided only by electrical activation waveforms applied to second side 24*b* of split heater 24.

Figure 2K:
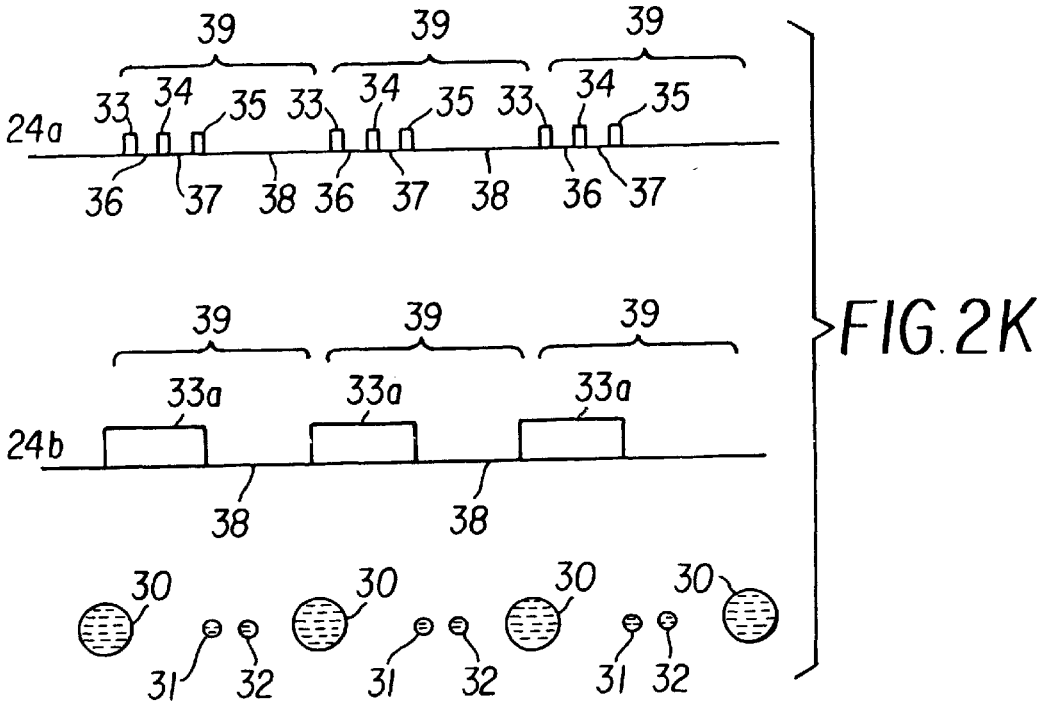

In accordance with this embodiment, as shown in FIG. 2K, the electrical activation waveform applied to the first side 24*a* is chosen to have a very small amplitude. A very small amplitude is an amplitude so small that ejected drops are not substantially steered when the electrical activation waveforms applied to the second side 24 are zero. In this embodiment, ejected drops are not steered by more than one tenth of a degree in drop trajectory. We have discovered that even for such very small amplitudes of the electrical activation waveform, first side 24*a* can alone act as a droplet forming mechanism 22, producing drops of various numbers and various sizes and spacings, as will be discussed.

In this alternative embodiment, steering of the ejected drops is provided by second side 24b. As shown in FIG. 2K, the electrical activation waveform applied to second side 24*b* is a single long pulse 33*a*. This single long pulse 33*a* applied to second side 24*b* does not substantially alter the droplet formation mechanism provided by first side 24*a*, but does cause the ejected drop trajectory to be steered as illustrated in FIG. 2F. In the absence of this single long pulse, drops are identically formed but their trajectories are not steered and thus the ejected drop trajectory is as illustrated in FIG. 2E. Therefore, in accordance with this alternative embodiment, the first side 24*a* of split heater 24 acts only as a droplet forming mechanism 22 and the second side 24*b* of split heater 24 acts only as a droplet steering mechanism 23, the two mechanisms functioning separately, for example under the control of controller 16.

It is also contemplated in accordance with the present invention that the droplet formation mechanism 22 and the droplet steering mechanism 23 need not be heaters of any type and may additionally have different physical embodiments. Many methods of droplet formation other than heaters are known to the art of inkjet printing as are methods of droplet steering. For example, piezoelectric elements are used commercially to induce drop formation in continuous inkjet printers, as electrostatic forces are used commercially to steer ink droplets. However, it is found that the preferred embodiment of a split heater 24 is advantageous in inexpensively combining the functions of droplet formation and droplet steering.

The preferred embodiments have been described for cases in which the droplet forming mechanism 22 is controlled to eject two small drops, 31 and 32, and one large drop 30. However, it is the function of droplet forming mechanism 22, to provide various numbers of drops of various sizes responsive to controller 16. Moreover, it is the function of droplet steering mechanism 23 to steer, in the slow scan direction, the various numbers and sizes of droplets so formed responsive to controller 16. Alternative embodiments for forming and steering droplets of various numbers and sizes are discussed in FIGS. 2L, 2M,and 2N in a manner analogous to discussions associated with FIGS. 2A, 2D, and 2K respectively; and in FIGS. 2O, 2P and 2Q in a manner analogous to discussions associated with FIGS. 2A, 2D, and 2K respectively.

Figure 2L:
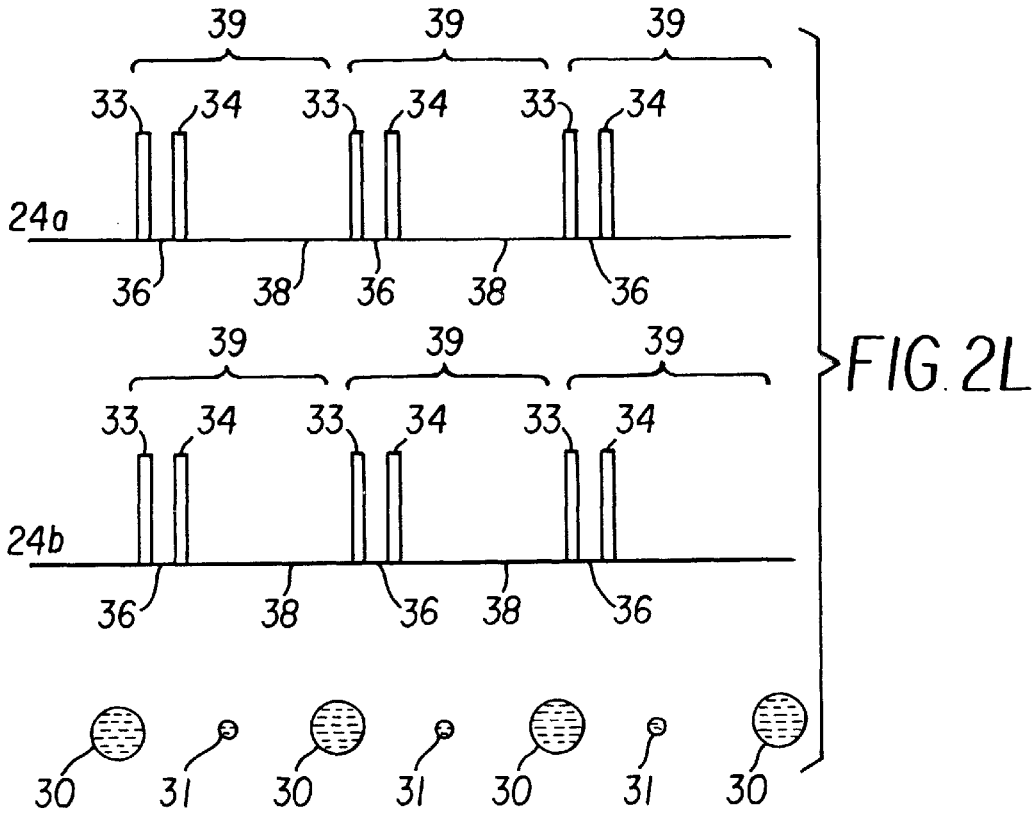
Figure 2M:
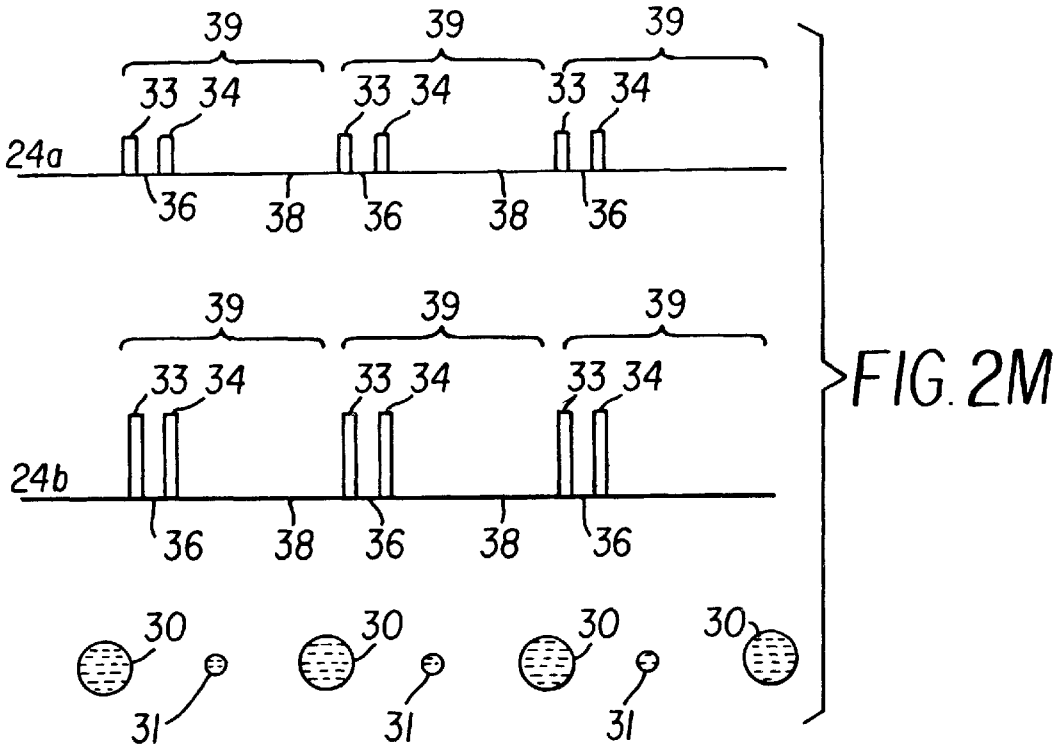
Figure 2N:
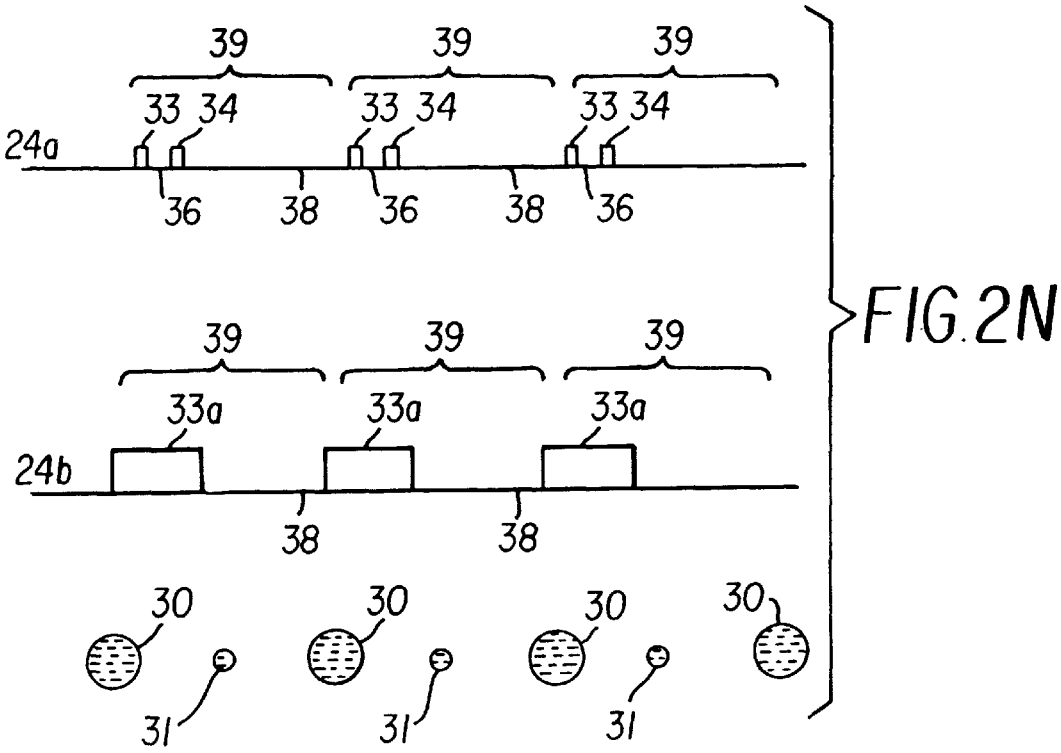

FIGS. 2L, 2M and 2N each depict an electrical activation waveform which ejects a single small drop 31 and a single large drop 30, but with the steering of the drops differing in each case. The directions of the trajectories followed by the drops are shown in FIGS. 2E for the case of the waveforms of FIG. 2L, and in FIG. 2F for the cases of the electrical activation waveforms of FIGS. 2M and 2N. It is understood that FIG. 2E and FIG. 2F correctly depict the direction of the trajectories of the ejected drops for the waveforms of FIGS. 2L, 2M,and 2N, but are not intended to show the drops formed for those waveforms, which are shown in FIGS. 2L, 2M and 2N themselves. In particular, two small drops 31, 32 are shown in FIG. 2E, 2F rather than a single small drop 31 as shown in FIG. 2L, 2M, and 2N.

Referring to FIGS. 2L, 2M,and 2N, as each image pixel time 39 remains substantially constant in a preferred embodiment of the invention, large droplet 30 will vary in size, volume, and mass depending on the number of small droplets 31, 32, 136 produced by split heater 24. In FIGS. 2L, 2M,and 2N, only one small droplet 31 is produced. As such, the volume of large droplet 30 is increased relative to the volume of large droplet 30 in FIGS. 2A, 2D, and 2K. The directions of the trajectories followed by the drops are shown in FIGS. 2E for the case of the waveforms of FIG. 2L, and in FIG. 2F for the cases of the electrical activation waveforms of FIGS. 2M and 2N.

Figure 20:
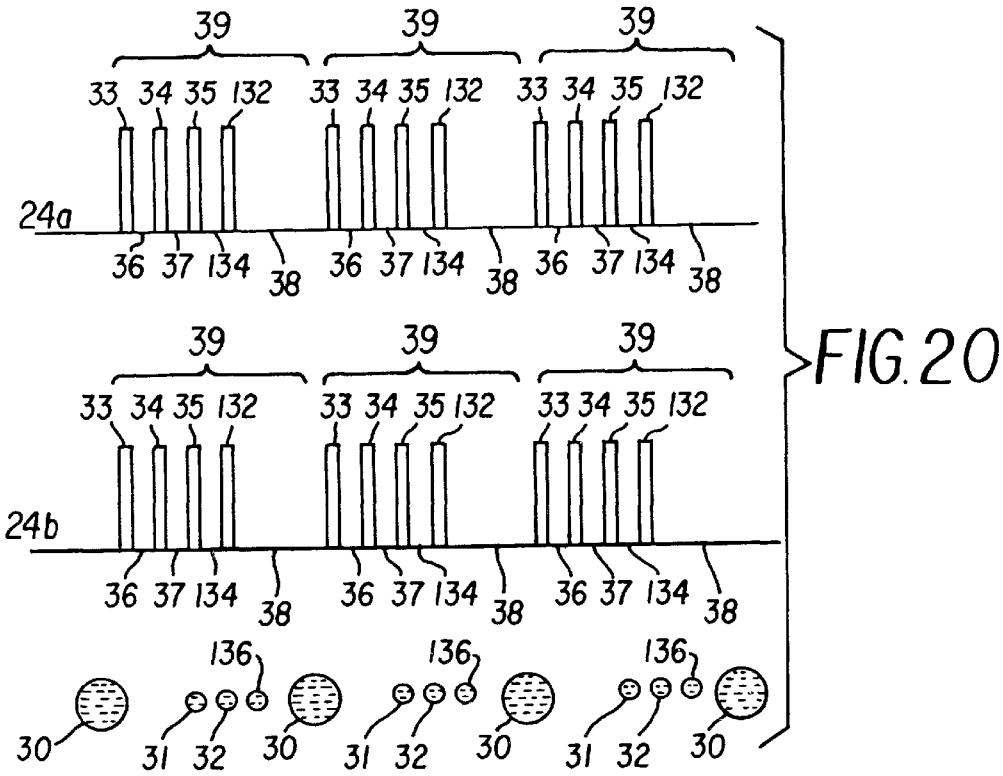
Figure 2P:
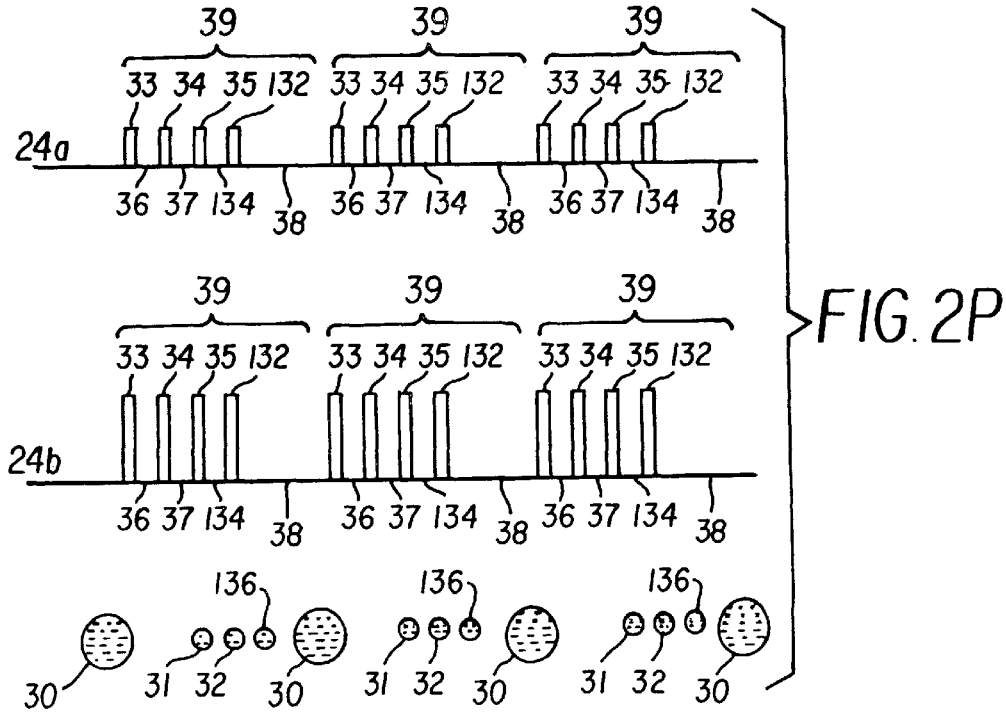
Figure 2Q:
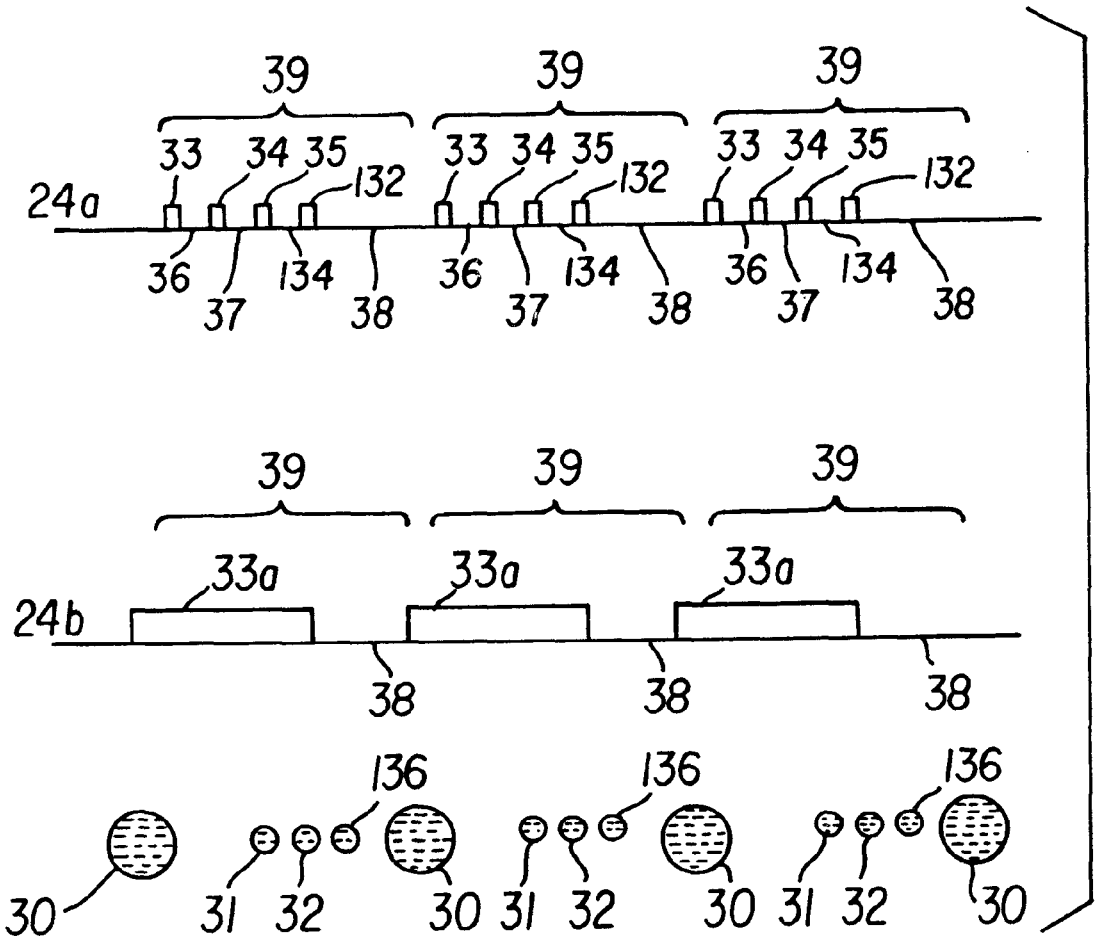

FIGS. 2O, 2P,and 2Q each depict an electrical activation waveform which ejects three small drops 31,32, 136 and a single large drop 30, but with the steering of the drops differing in each case. The directions of the trajectories followed by the drops are shown in FIGS. 2E for the case of the waveforms of FIG. 20, and in FIG. 2F for the cases of the electrical activation waveforms of FIGS. 2P and 2Q. It is understood that FIG. 2E and FIG. 2F correctly depict the direction of the trajectories of the ejected drops for the waveforms of FIGS. 2O, 2P,and 2Q, but are not intended to show the drops formed for those waveforms, which are shown in FIGS. 2O, 2P,and 2Q themselves. In particular, two small drops 31,32 are shown in FIG. 2E, 2F rather than three small drops 31,32,136 as shown in FIGS. 2O, 2P, and 2Q.

Referring to FIGS. 2O, 2P,and 2Q, as each image pixel time 39 remains substantially constant in a preferred embodiment of the invention, large droplet 30 will vary in size, volume, and mass depending on the number of small droplets 31, 32, 136 produced by split heater 24. In FIGS. 2O, 2P,and 2Q, three small droplets 31,32,136 are produced. As such, the volume of large droplet 30 is decreased relative to the volume of large droplet 30 in FIGS. 2A, 2D, and 2K. The directions of the trajectories followed by the drops are shown in FIGS. 2E for the case of the waveforms of FIG. 2O, and in FIG. 2F for the cases of the electrical activation waveforms of FIGS. 2P and 2Q.

The volume of large droplets 30 in FIG. 2F is still greater than the volume of small droplets 31, 32, 136, preferably by at least a factor of four (4) in a preferred embodiment as described above. Droplet 136 is produced by activating split heater 24 for an electrical pulse time 132 after split heater 24 has been deactivated by a delay time 134.

In a preferred implementation, small droplets 31, 32, 136 form printed droplets that impinge on print media W while large droplets 30 are collected by ink guttering structure 60. However, it is specifically contemplated that large droplets 30 can form printed droplets while small droplets 31, 32, 136 are collected by ink guttering structure 60. This can be accomplished by repositioning ink guttering structure 60, in any known manner, such that ink guttering structure 60 collects small droplets 31, 32, 136. Printing in this manner provides printed droplets having varying sizes and volumes.

Figure 3:
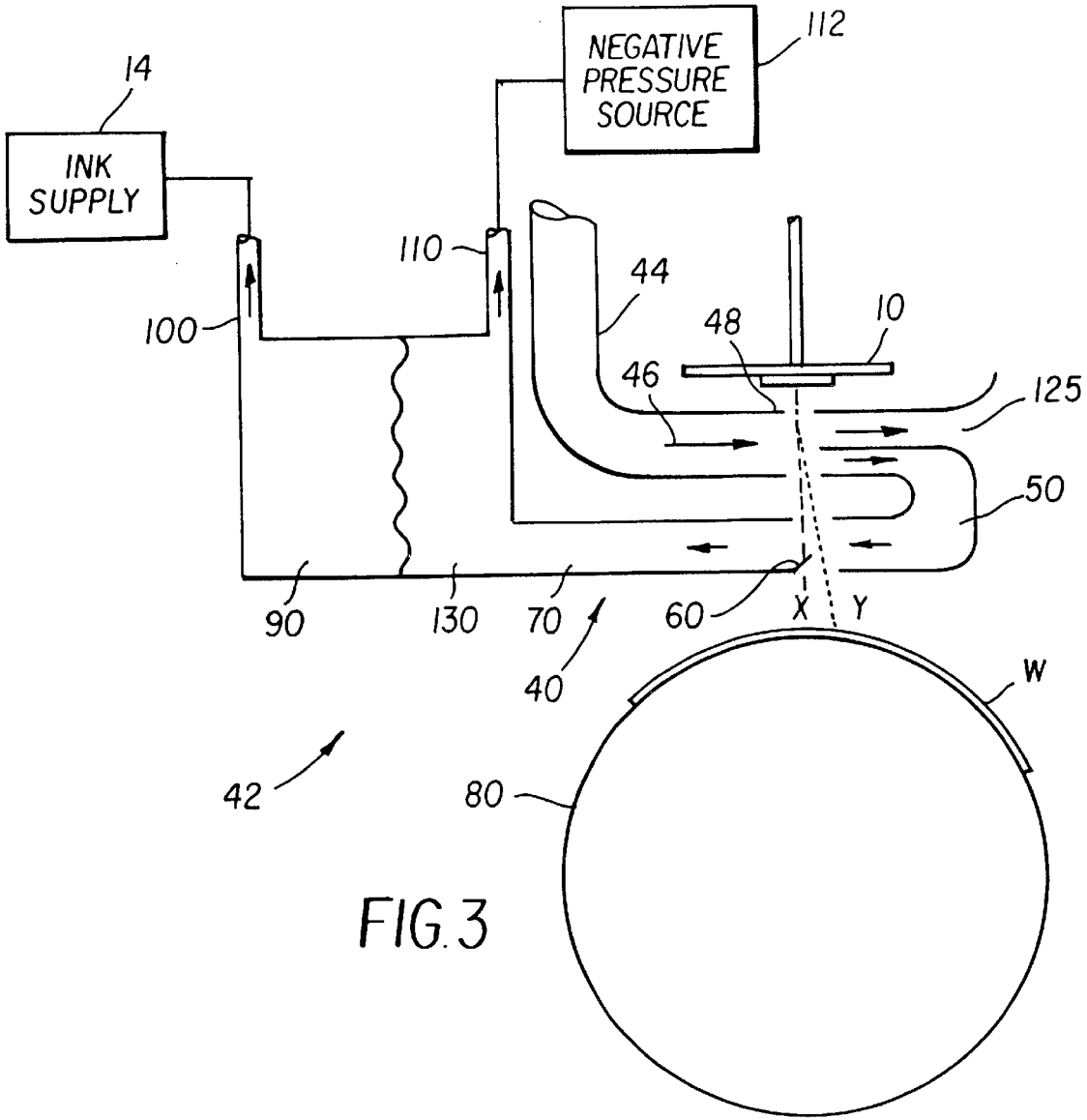
FIG. 3 is a schematic view of an ink jet printer made in accordance with the preferred embodiment of the present invention.

Referring to FIG. 3, one embodiment of a printing apparatus 42 (typically, an ink jet printer or printhead) made in accordance with the present invention is shown. Large volume ink droplets 30 and small volume ink droplets 31 and 32 are ejected from integrated printhead 10 substantially along path X in a stream. A droplet deflector system 40 applies a force (shown generally at 46) to ink droplets 30, 31, and 32 as ink droplets 30, 31, and 32 travel along path X. Force 46 interacts with ink droplets 30, 31, and 32 along path X, causing the ink droplets 31 and 32 to alter course. As ink droplets 30 have different volumes and masses from ink droplets 31 and 32, force 46 causes small droplets 31 and 32 to separate from large droplets 30 with small droplets 31 and 32 diverging from path X along small droplet or printed path Y. While large droplets 30 can be slightly affected by force 46, large droplets 30 remain travelling substantially along path X. However, as the volume of large droplets 30 is decreased, large droplets 30 can diverge slightly from path X and begin traveling along a gutter path Z (shown in greater detail with reference to FIG. 4). The interaction of force 46 with ink droplets 30, 31, and 32 is described in greater detail below with reference to FIG. 4.

Droplet deflector system 40 can include a gas source that provides force 46. Typically, force 46 is positioned at an angle with respect to the stream of ink droplets operable to selectively deflect ink droplets depending on ink droplet volume. Ink droplets having a smaller volume are deflected more than ink droplets having a larger volume.

Droplet deflector system 40 facilitates laminar flow of gas through a plenum 44. An end 48 of the droplet deflector system 40 is positioned proximate path X. An ink recovery conduit 70 is disposed opposite a recirculation plenum 50 of droplet deflector system 40 and promotes laminar gas flow while protecting the droplet stream moving along path X from air external air disturbances. Ink recovery conduit 70 contains a ink guttering structure 60 whose purpose is to intercept the path of large droplets 30, while allowing small ink droplets 31, 32, traveling along small droplet path Y, to continue on to a recording media W carried by a print drum 80.

Ink recovery conduit 70 communicates with an ink recovery reservoir 90 to facilitate recovery of non-printed ink droplets by an ink return line 100 for subsequent reuse. Ink recovery reservoir 90 can include an open-cell sponge or foam 130, which prevents ink sloshing in applications where the integrated printhead 10 is rapidly scanned. A vacuum conduit 110, coupled to a negative pressure source 112 can communicate with ink recovery reservoir 90 to create a negative pressure in ink recovery conduit 70 improving ink droplet separation and ink droplet removal. The gas flow rate in ink recovery conduit 70, however, is chosen so as to not significantly perturb small droplet path Y. Additionally, gas recirculation plenum 50 diverts a small fraction of the gas flow crossing ink droplet path X to provide a source for the gas which is drawn into ink recovery conduit 70.

In a preferred implementation, the gas pressure in droplet deflector system 40 and in ink recovery conduit 70 are adjusted in combination with the design of ink recovery conduit 70 and recirculation plenum 50 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70.

In operation, a recording media W is transported in a direction transverse to path X by print drum 80 in a known manner. Transport of recording media W is coordinated with movement of integrated printhead 10. This can be accomplished using controller 16 in a known manner.

Figure 4:
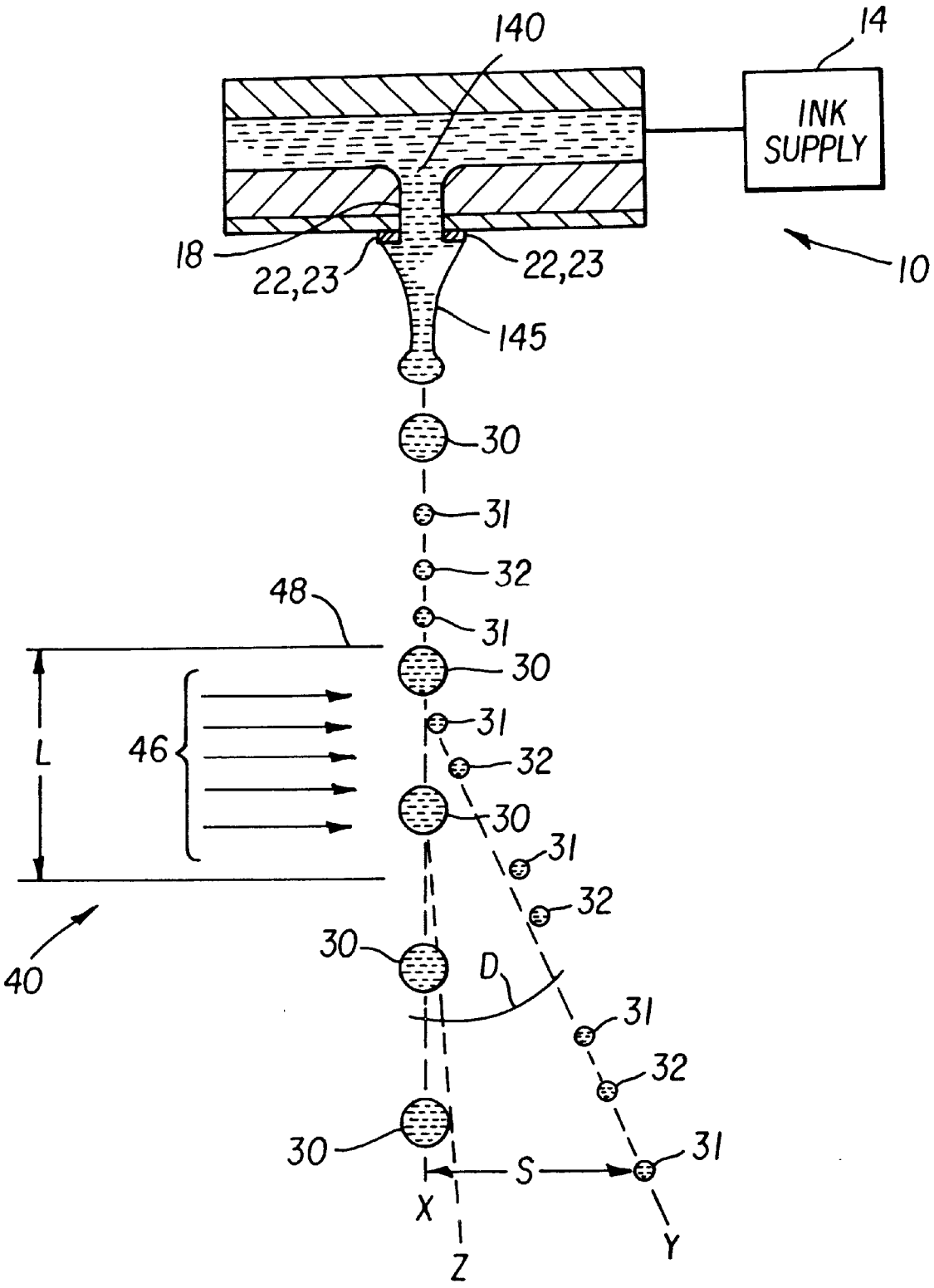
FIG. 4 is a partial cross-sectional schematic view of an inkjet printhead made in accordance with the preferred embodiment of the present invention.

Referring to FIG. 4, another embodiment of the present invention is shown. Pressurized ink 140 from ink supply 14 is ejected through nozzle 18 of integrated printhead 10 creating a filament of working fluid 145. Droplet forming mechanism 138, for example split heater 24, is selectively activated at various frequencies causing filament of working fluid 145 to break up into a stream of individual ink droplets 30, 31, 32 with the volume of each ink droplet 30, 31, 32 being determined by the frequency of activation of split heater 24.

During printing, droplet forming mechanism 22, for example, side 24*a* of split heater 24, is selectively activated creating the stream of ink having a plurality of ink droplets having a plurality of volumes and droplet deflector system 40 is operational. After formation, large volume droplets 30 also have a greater mass and more momentum than small volume droplets 31 and 32. As gas force 46 interacts with the stream of ink droplets, the individual ink droplets separate depending on each droplets volume and mass. Accordingly, the gas flow rate in droplet deflector system 40 can be adjusted to sufficient differentiation in the small droplet path Y from the large droplet path X, permitting small volume droplets 31 and 32 to strike print media W while large volume droplets 30 travel downward remaining substantially along path X or diverging slightly and travelling along gutter path Z. Ultimately, droplets 30 strike ink guttering structure 60 or otherwise to fall into recovery conduit 70.

In the event that droplets 31, 32 are found to be misaligned, for example, misaligned in a slow scan direction on print media W, ink droplet steering mechanism 23 is actuated, as described above to correct this misalignment. As such, ink droplet steering mechanism 23 is integrated on printhead 10 so as to correct ink drop misalignment in the slow scan direction. Typically, ink drop misalignment in the slow scan direction is viewed from the fast scan direction, as described above. Ink droplet steering mechanism 23 can be, for example, side 24*b* of split heater 24. Alternatively, ink droplet steering mechanism 23 can be side 24*a* of split heater 24 with ink droplet forming mechanism 22 being side 24*b* of split heater 24.

A positive force 46 (gas pressure or gas flow) at end 48 of droplet deflector system 40 tends to separate and deflect ink droplets 31 and 32 away from ink recovery conduit 70 as ink droplets 31, 32 travel toward print media W. An amount of separation between large volume droplets 30 and small volume droplets 31 and 32 (shown as S in FIG. 4) will not only depend on their relative size but also the velocity, density, and viscosity of the gas coming from droplet deflector system 40; the velocity and density of the large volume droplets 30 and small volume droplets 31 and 32; and the interaction distance (shown as L in FIG. 4) over which the large volume droplets 30 and the small volume droplets 31 and 32 interact with the gas flowing from droplet deflector system 40 with force 46. Gases, including air, nitrogen etc., having different densities and viscosities can be used with similar results.

Large volume droplets 30 and small volume droplets 31 and 32 can be of any appropriate relative size. However, the droplet size is primarily determined by ink flow rate through nozzle 18 and the frequency at which split heater 24 is cycled. The flow rate is primarily determined by the geometric properties of nozzle 18 such as nozzle diameter and length, pressure applied to the ink, and the fluidic properties of the ink such as ink viscosity, density, and surface tension. As such, typical ink droplet sizes may range from, but are not limited to, 1 to 10,000 picoliters.

Although a wide range of droplet sizes are possible, at typical ink flow rates, for a 10 micron diameter nozzle, large volume droplets 30 can be formed by cycling heaters at a frequency of about 50 kHz producing droplets of about 20 picoliter in volume and small volume droplets 31 and 32 can be formed by cycling heaters at a frequency of about 200 kHz producing droplets that are about 5 picoliter in volume. These droplets typically travel at an initial velocity of 10 m/s. Even with the above droplet velocity and sizes, a wide range of separation distances S between large volume and small volume droplets is possible depending on the physical properties of the gas used, the velocity of the gas and the interaction distance L, as stated previously. For example, when using air as the gas, typical air velocities may range from, but are not limited to 100 to 1000 cm/s while interaction distances L may range from, but are not limited to, 0.1 to 10 mm.

Nearly all fluids have a non-zero change in surface tension with temperature. Split heater 24 is therefore able to break up working fluid 145 into droplets 30, 31, 32, allowing print mechanism 10 to accommodate a wide variety of inks, since the fluid breakup is driven by spatial variation in surface tension within working fluid 145, as is well known in the art. The ink can be of any type, including aqueous and non-aqueous solvent based inks containing either dyes or pigments, etc. Additionally, plural colors or a single color ink can be used.

The ability to use any type of ink and to produce a wide variety of droplet sizes, separation distances (shown as S in FIG. 4), and droplet deflections (shown as divergence angle D in FIG. 4) allows printing on a wide variety of materials including paper, vinyl, cloth, other fibrous materials, etc. The invention also has very low energy and power requirements because only a small amount of power is required to form large volume droplets 30 and small volume droplets 31 and 32. Additionally, print mechanism 10 does not require electrostatic charging and deflection devices, and the ink need not be in a particular range of electrical conductivity. While helping to reduce power requirements, this also simplifies construction of integrated printhead 10 and control of droplets 30, 31 and 32.

Integrated printhead 10 can be manufactured using known techniques, such as CMOS and MEMS techniques. Additionally, integrated printhead 10 can incorporate a heater, a piezoelectric actuator, a thermal actuator, etc., in order to create ink droplets 30, 31, 32. There can be any number of nozzles 18 and the distance between nozzles 18 can be adjusted in accordance with the particular application to avoid ink coalescence, and deliver the desired resolution.

Integrated printhead 10 can be formed using a silicon substrate, etc. Also, integrated printhead 12 can be of any size and components thereof can have various relative dimensions. Split heater 24, electrical contact pad 26, and conductor 28 can be formed and patterned through vapor deposition and lithography techniques, etc. Split heater 24 can include heating elements of any shape and type, such as resistive heaters, radiation heaters, convection heaters, chemical reaction heaters (endothermic or exothermic), etc. The invention can be controlled in any appropriate manner. As such, controller 16 can be of any type, including a microprocessor based device having a predetermined program, etc.

Droplet deflector system 40 can be of any type and can include any number of appropriate plenums, conduits, blowers, fans, etc. Additionally, droplet deflector system 40 can include a positive pressure source, a negative pressure source, or both, and can include any elements for creating a pressure gradient or gas flow. Ink recovery conduit 70 can be of any configuration for catching deflected droplets and can be ventilated if necessary.

Print media W can be of any type and in any form. For example, the print media can be in the form of a web or a sheet. Additionally, print media W can be composed from a wide variety of materials including paper, vinyl, cloth, other large fibrous materials, etc. Any mechanism can be used for moving the printhead relative to the media, such as a conventional raster scan mechanism, etc.

Figure 5:
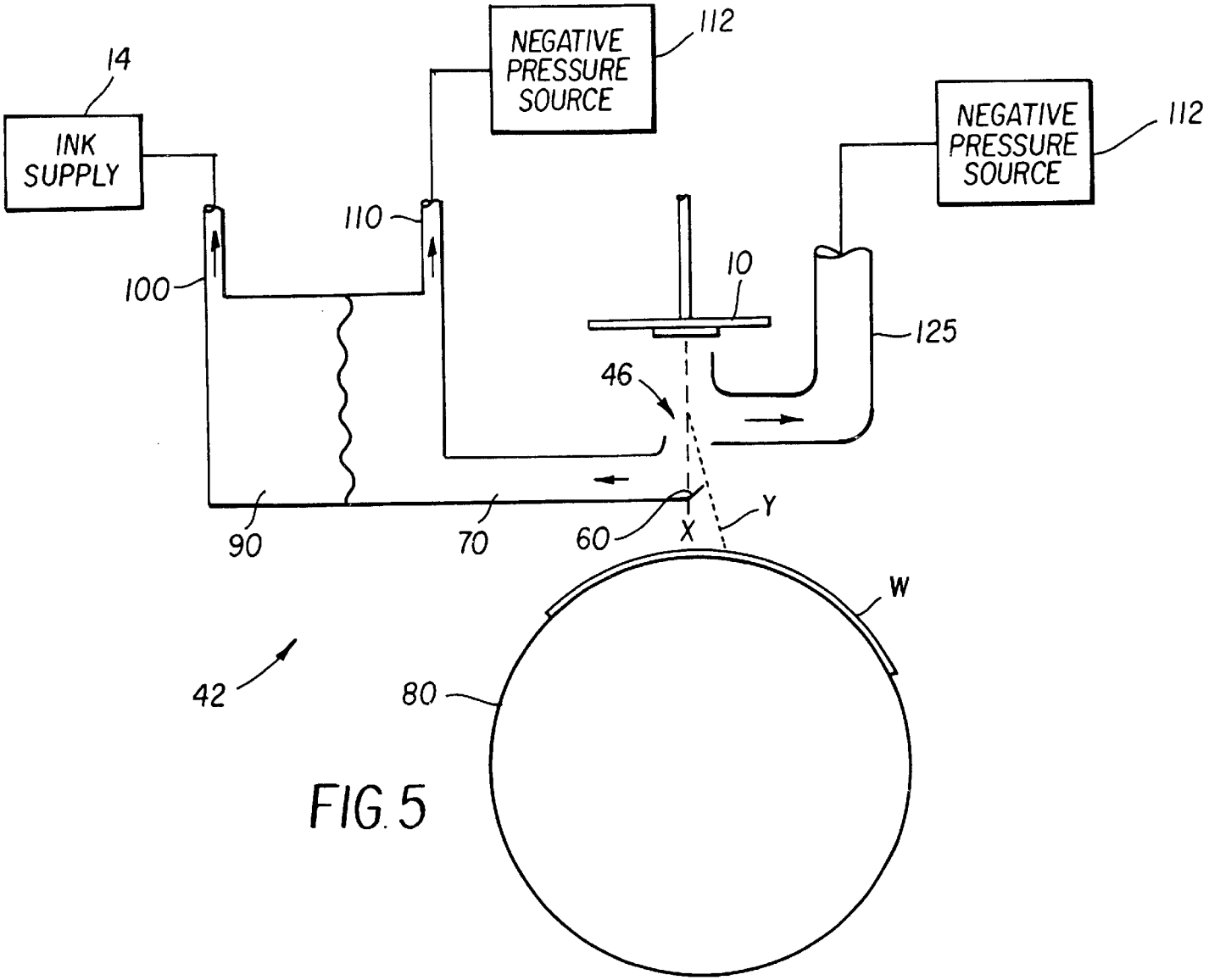
FIG. 5 is schematic view of an ink jet printer made in accordance with an alternative embodiment of the present invention.

Referring to FIG. 5, another embodiment of the present invention is shown with like elements being described using like reference signs. Deflector plenum 125 applies force (shown generally at 46) to ink droplets 30, 31 and 32 as ink droplets 30, 31 and 32 travel along path X. Force 46 interacts with ink droplets 30, 31 and 32 along path X, causing ink droplets 31 and 32 to alter course. As ink droplets 30, 31, and 32 have different volumes and masses, force 46 causes small droplets 31 and 32 to separate from large droplets 30 with small droplets 31 and 32 diverging from path X along path small droplet path Y. Large droplets 30 can be slightly affected by force 46. As such, large droplets 30 either continue to travel along large droplet path X or diverge slightly and begin travelling along gutter path Z which is only slightly deviated from path X. In FIG. 5, force 46 originates from a negative pressure created by a vacuum source, negative pressure source 112, etc. and communicated through deflector plenum 125.

In the embodiments discussed above, a controller 16 is provided to control the trajectory of ink drops 30, 31, 32 ejected from the nozzle 18 in the slow scan direction which controls the placement of ink drops on a recording medium in the slow scan. As such, a simplified printhead and printer having reduced image artifacts due to ink drop misalignment in the slow scan direction is provided. It is also contemplated that if the printed ink drop position, in the slow scan direction, differs from the desired printed position, ink drop misplacement is corrected by controlling or modifying the electrical activation waveforms provided to integrated printhead 10. In order to accomplish this, the extent of ink drop misplacement in the slow scan direction of ink drops ejected from one or more printhead nozzles is ascertained. This can be accomplished using any device and/or method known in the art. In the event that correction is needed, voltage waveforms from controller 16 provide electrical activation waveforms so as to correct misplacement. To this extent, it is understood that the slow scan direction is generally perpendicular to the direction of motion of the recording medium and the integrated printhead 10 during a fast scan printing of one or more image swaths.

As is well known in the art of inkjet printing, misplacement errors may be determined by observing, for example with a digital imager, etc., the placement of ink drops intended to be printed at particular locations. Then, using a look-up table to determine the appropriate electrical activation waveforms to be provided to integrated printed 10. Alternatively, determination procedures, for example, the procedure of using an optical sensor including a quad photodiode detector whose outputs are indicative of the positions of vertical test lines; projecting light upon a flying ink drop and detecting misalignment by the amount of light reflected; using an optical technique for detecting droplet position; and using a piezoelectric detector for drop position determination, can be used. It is contemplated that determining the extent of ink drop misplacement can be made repeatedly, correcting as necessary, thereby reducing subsequent errors in ink drop placement during each printing iteration as look-up tables are refined.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for printing an image comprising:

a source of ink;

a droplet forming mechanism operable in a first state to form droplets from the ink of the source having a first volume traveling along a first desired path and in a second state to form droplets from the ink of the source having a second volume traveling along the first desired path, the droplet forming mechanism being positioned proximate the source;

a first system which selectively applies a first force to the ink of the source such that selected droplets formed from the ink of the source by the droplet forming mechanism travel along a second desired path, the first system being positioned proximate the ink source; and a second system which applies a second force to the droplets traveling along at least one of the first desired path and the second desired path, the second force being applied in a direction such that the droplets having the first volume diverge from the droplets having the second volume.

2. The apparatus according to claim 1, wherein the second force is applied in a direction substantially perpendicular to at least one of the first desired path and the second desired path.

3. The apparatus according to claim 1, wherein the first force is applied to the source such that a difference in direction between the first and second desired paths of the selected droplets is substantially perpendicular to the second force.

4. The apparatus according to claim 1, wherein the first force is heat.

5. The apparatus according to claim 1, wherein the second force is a positive pressure force.

6. The apparatus according to claim 5, wherein the second force includes a gas flow.

7. The apparatus according to claim 1, wherein a trajectory of the second desired path is substantially equal to a trajectory of the first desired path.

8. A printhead comprising:

a droplet forming mechanism operable in a first state to form droplets from a fluid stream having a first volume traveling along a first desired path and in a second state to form droplets from the fluid stream having a second volume traveling along the first desired path;

a droplet steering system positioned relative to the droplet forming mechanism which selectively applies a first force to the fluid stream such that selected droplets formed from the fluid stream travel along a second desired path, the first force being applied to the fluid stream while the fluid stream is in contact with a portion of the droplet steering system; and a droplet deflector system positioned relative to the droplet forming mechanism which applies a second force to the droplets traveling along at least one of the first desired path and the second desired path, the second force being applied in a direction such that the droplets having the first volume diverge from at least one of the first desired path and the second desired path.

9. The printhead according to claim 8, wherein the second force is applied in a direction substantially perpendicular to the desired path.

10. The printhead according to claim 8, wherein the droplet steering mechanism is a heater.

11. The printhead according to claim 8, wherein the droplet forming mechanism is a heater.

12. The printhead according to claim 11, wherein the heater is a split heater.

13. The printhead according to claim 12, wherein the split heater includes at least a first side and a second side, the droplet steering mechanism being at least one of the first side and the second side of the split heater.

14. The printhead according to claim 8, the printhead having a surface, wherein the desired path is substantially perpendicular to said surface.

15. The printhead according to claim 8, further comprising:

a controller electrically connected to the droplet forming mechanism, the controller being configured to selectively actuate the droplet forming mechanism at a plurality of frequencies such that the droplets having one of the first volume and the second volume are formed.

16. The printhead according to claim 8, further comprising:

a controller electrically connected to the droplet steering mechanism, the controller being configured to selectively actuate the droplet steering mechanism at a plurality of frequencies such that the droplets resume traveling along the desired path.

17. The printhead according to claim 8, wherein a trajectory of the second desired path is substantially equal to a trajectory of the first desired path.

18. An inkjet printer comprising:

a source of ink;

a printhead having a droplet forming mechanism operable in a first state to form droplets from the source having a first volume traveling along a desired path and in a second state to form droplets from the source having a second volume traveling along the desired path;

a droplet steering system positioned on the printhead and relative to the droplet forming mechanism which selectively applies a first force to the droplets formed from the source such that the droplets formed from the source travel along a second desired path; and a droplet deflector system positioned relative to the droplet forming mechanism which applies a second force to the droplets traveling along at least one of the desired path and the second desired path, the second force being applied in a direction such that the droplets having the first volume diverge from at least one of the desired path and the second desired path.

19. The inkjet printer according to claim 18, wherein at least a portion of the droplet deflector system is positioned adjacent to the desired path such that second force is applied in a direction substantially perpendicular to the desired path.

20. The inkjet printer according to claim 19, wherein the second force is a positive pressure gas force.

21. The inkjet printer according to claim 20, wherein the gas is at least one of air and nitrogen.

22. The inkjet printer according to claim 18, the printhead having a surface, portions of the surface defining a nozzle, wherein the droplet forming mechanism is a heater positioned proximate to the nozzle.

23. The inkjet printer according to claim 22, wherein the heater is a split heater.

24. The inkjet printer according to claim 23, wherein the split heater includes at least a first side and a second side with each side being positioned on the printhead surface on opposite sides of the nozzle.

25. The inkjet printer according to claim 24, wherein the droplet steering mechanism is at least one of the first side and the second side of the split heater.

26. The inkjet printer according to claim 18, the printhead having a surface, portions of the surface defining a nozzle, wherein the droplet steering mechanism is a heater positioned proximate to the nozzle.

27. The inkjet printer according to claim 26, wherein the heater is a split heater.

28. The inkjet printer according to claim 27, wherein the split heater includes at least a first side and a second side with each side being positioned on the printhead surface on opposite sides of the nozzle.

29. The inkjet printer according to claim 28, wherein the droplet forming mechanism is at least one of the first side and the second side of the split heater.

30. The inkjet printer according to claim 18, the printhead having a surface, wherein the desired path is substantially perpendicular to the surface of the printhead.

31. The inkjet printer according to claim 18, further comprising:

a controller electrically connected to the droplet forming mechanism, the controller being configured to selectively actuate the droplet forming mechanism at a plurality of frequencies such that the droplets having one of the first volume and the second volume are formed.

32. The inkjet printer according to claim 18, further comprising:

a controller electrically connected to the droplet steering mechanism, the controller being configured to selectively actuate the droplet steering mechanism at a plurality of frequencies such that the droplets resume traveling along the desired path.

33. The inkjet printer according to claim 18, further comprising:

a gutter shaped to collect one of droplets diverging from the desired path and droplets traveling along the desired path, the gutter being positioned in one of a diverging path and the desired path.

34. The inkjet printer according to claim 18, wherein a trajectory of the second desired path is substantially equal to a trajectory of the desired path.

35. A method of printing an image having corrected ink droplet placement comprising:

forming droplets having a first volume traveling along a desired path;

forming droplets having a second volume traveling along the desired path;

causing the droplets having the first volume to diverge from the desired path;

collecting the droplets having one of the first volume and the second volume allowing the droplets having the other of the first volume and the second volume to impinge upon a recording media;

determining when the droplets having one of the first volume and the second volume begin traveling along an undesired path; and correcting the droplets having one of the first volume and the second volume such that the droplets resume traveling along the desired path by applying a force to fluid while the fluid is in contact with a portion of a droplet steering system that generates the force, wherein the droplets having at least one of the first volume and the second volume are formed from the fluid.

36. The method according to claim 35, wherein determining when the droplets having one of the first volume and the second volume begin traveling along an undesired path includes determining when droplet placement error begins in a direction perpendicular to a fast scan direction.

37. The method according to claim 35, wherein correcting the droplets having one of the first volume and the second volume such that the droplets resume traveling along the desired path includes controlling the droplets traveling path in a direction substantially perpendicular to a fast scan printing direction.

38. The method according to claim 37, wherein controlling the droplets traveling path includes varying a ratio of voltages applied to the droplet steering system.

39. The method according to claim 35, wherein forming droplets having a first volume and a second volume includes actuating a droplet forming mechanism at a plurality of frequencies.

40. The method according to claim 35, further comprising:

recycling the droplets having one of the first volume and the second volume for subsequent use.

41. A method of correcting droplet placement error in a plurality of nozzles aligned in a row comprising:

forming droplets from a first nozzle traveling along a first desired path;

forming droplets from a second nozzle traveling along a second desired path, the second desired path being substantially parallel to the first desired path as viewed in a direction perpendicular to the row and perpendicular to a fast scan direction;

determining when the second desired path is other than parallel to the first desired path;

causing the second desired path to resume being parallel to the first desired path by applying a force from a droplet steering mechanism to fluid from the second nozzle while the fluid is in contact with a portion of the droplet steering mechanism, wherein the droplets are formed from the fluid.

42. The method according to claim 41, wherein determining when the second desired path is other than parallel to the first desired path includes determining when the second desired path is other than parallel as viewed in a direction perpendicular to the fast scan direction.

43. The method according to claim 41, wherein applying the force from the droplet steering mechanism includes varying a ratio of voltages applied to the droplet steering mechanism.

44. The method according to claim 41, further comprising:

forming droplets having a first volume traveling along the first desired path and the second desired path;

forming droplets having a second volume traveling along the first desired path and the second desired path; and causing the droplets having the first volume to diverge from the first desired path and the second desired path.

45. The method according to claim 44, wherein forming droplets having a first volume and a second volume includes actuating a droplet forming mechanism at a plurality of frequencies.

46. A printhead having a length dimension comprising:

a nozzle;

a droplet forming mechanism including a split heater positioned about the nozzle;

a droplet deflector system positioned such that a gas flow is applied in a direction substantially perpendicular to the length dimension of the printhead a viewed from a plane perpendicular to the length dimension; and a droplet steering mechanism including the split heater positioned about the nozzle such that a droplet steering force is applied in a direction substantially perpendicular to the gas flow as viewed from a plane parallel to the length dimension of the printhead.

47. The printhead according to claim 46, further comprising:

a controller electrically connected to the droplet forming mechanism, the controller being configured to selectively actuate the droplet forming mechanism at a plurality of frequencies such that droplets having one of a first volume and a second volume are formed.

48. The printhead according to claim 46, further comprising:

a controller electrically connected to the droplet steering mechanism, the controller being configured to selectively provide the droplet steering mechanism with an electrical activation waveform such that the droplets having one of the first volume and the second volume resume traveling along a desired path.

* * * * *

UNITED STATES PATENT AND TRADEMARK OFFICE

CERTIFICATE OF CORRECTION

PATENT NO. : 6,517,197 B2
DATED : February 11, 2003
INVENTOR(S) : Gilbert A. Hawkins et al.

It is certified that error appears in the above-identified patent and that said Letters Patent is hereby corrected as shown below:

Title page,
Item [54], Title, should read as follows:
-- A CONTINUOUS INK-JET PRINTING METHOD AND APPARATUS FOR CORRECTING INK DROP PLACEMENT --

Signed and Sealed this

Twelfth Day of April, 2005

JON W. DUDAS
*Director of the United States Patent and Trademark Office*